US006742993B2

(12) United States Patent
Savard et al.

(10) Patent No.: US 6,742,993 B2
(45) Date of Patent: Jun. 1, 2004

(54) METHOD AND APPARATUS FOR DISPENSING FLUIDS

(75) Inventors: Raymond T. Savard, Pilot Point, TX (US); John C. Vines, Dallas, TX (US)

(73) Assignee: Integrated Designs, L.P., Carrollton, TX (US)

( * ) Notice: Subject to any disclaimer, the term of this patent is extended or adjusted under 35 U.S.C. 154(b) by 0 days.

(21) Appl. No.: 10/065,701

(22) Filed: Nov. 11, 2002

(65) Prior Publication Data

US 2003/0062382 A1 Apr. 3, 2003

Related U.S. Application Data

(63) Continuation of application No. 09/691,627, filed on Oct. 18, 2000, now Pat. No. 6,478,547.

(60) Provisional application No. 60/160,219, filed on Oct. 18, 1999.

(51) Int. Cl.[7] ..... F04B 19/24

(52) U.S. Cl. ..... 417/53; 417/413.1; 222/63; 222/61; 403/1; 403/293

(58) Field of Search ..... 417/53, 413.1; 222/63, 61; 403/1, 293, 296, 309, 310, 312

(56) References Cited

U.S. PATENT DOCUMENTS

| | | | | | |
|---|---|---|---|---|---|
| 73,100 | A | * | 1/1868 | Hubbard | 403/309 |
| 111,152 | A | * | 1/1871 | Smith | 403/312 |
| 292,978 | A | * | 2/1884 | Braun | 403/309 |
| 1,448,506 | A | * | 3/1923 | Prellwitz | 403/312 |
| 4,036,112 | A | | 7/1977 | Hubschmann | |
| 4,448,692 | A | | 5/1984 | Nakamoto et al. | |
| 4,483,665 | A | | 11/1984 | Hauser | |
| 4,493,435 | A | | 1/1985 | Hartley | |
| 4,569,378 | A | | 2/1986 | Bergandy | |
| 4,593,720 | A | | 6/1986 | Bergandy | |
| 4,601,409 | A | | 7/1986 | DiRegolo | |
| 4,749,342 | A | | 6/1988 | Fritsch | |
| 4,773,305 | A | | 9/1988 | Nissels | |
| 4,863,066 | A | | 9/1989 | Uffenheimer et al. | |
| 4,950,134 | A | | 8/1990 | Bailey et al. | |
| 4,966,076 | A | * | 10/1990 | John | 101/216 |
| 5,062,734 | A | * | 11/1991 | Vanzee et al. | 403/313 |
| 5,167,837 | A | | 12/1992 | Snodgrass et al. | |
| 5,262,068 | A | | 11/1993 | Bowers et al. | |
| 5,316,181 | A | | 5/1994 | Burch | |
| 5,320,250 | A | * | 6/1994 | La et al. | 222/1 |
| 5,490,765 | A | | 2/1996 | Bailey et al. | |
| 5,516,429 | A | | 5/1996 | Snodgrass et al. | |
| 5,527,161 | A | | 6/1996 | Bailey et al. | |
| 5,531,536 | A | * | 7/1996 | Blanchfield et al. | 403/340 |
| 5,586,832 | A | * | 12/1996 | Zylka | 403/344 |

(List continued on next page.)

OTHER PUBLICATIONS

Ted Snodgrass, et al., "Advanced Dispersing and Coating Technologies for Polyimide Films," Fas Technologies, Inc., pp. 1–12, (Nov. 9, 1992).

Michael E. Clarke, "Understanding the Operation Cycles of Millipore Two–Stage Technology Photochemical Dispense Systems," Microelectronics Applications Note MAL 111, Millipore Corporation (USA), pp. 1–8, (Mar. 2, 1999).

*Primary Examiner*—Justine R. Yu
*Assistant Examiner*—William H. Rodriguez
(74) *Attorney, Agent, or Firm*—Munsch, Hardt, Kopf & Harr, P.C.

(57) ABSTRACT

A method and system for dispensing a precise amount of a chemical used in the fabrication of semiconductors utilizes rolling membrane pump and calculates an amount by which to change a dispense based at least in part on a predicted membrane flex. Membrane flex is predicted, at least in part, by the shape of the membrane, a volume of liquid to be dispensed and a pressure during dispense.

24 Claims, 15 Drawing Sheets

U.S. PATENT DOCUMENTS 5,762,795 A 6/1998 Bailey et al.
5,772,899 A 6/1998 Snodgrass et al.
5,848,605 A 12/1998 Bailey et al.
5,913,455 A 6/1999 La et al.
6,109,881 A * 8/2000 Snodgrass et al. ..... 417/53
6,135,670 A * 10/2000 Bahnman et al. ..... 403/373
6,190,565 B1 2/2001 Bailey et al.
6,251,293 B1 * 6/2001 Snodgrass et al. ..... 210/767
6,419,841 B1 * 7/2002 Snodgrass et al. ..... 210/767

* cited by examiner

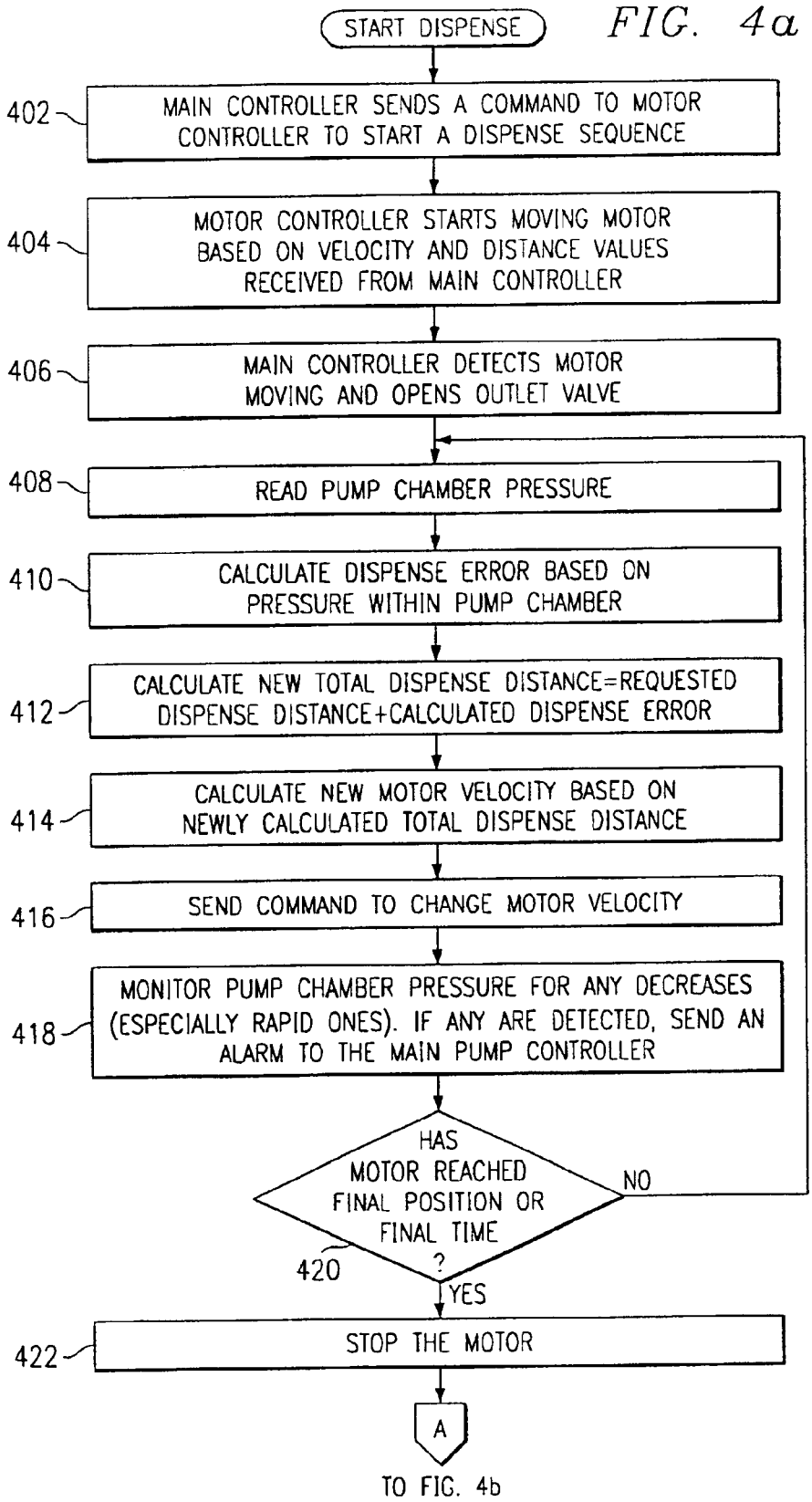
FIG. 4a
START DISPENSE
402
MAIN CONTROLLER SENDS A COMMAND TO MOTOR CONTROLLER TO START A DISPENSE SEQUENCE
404
MOTOR CONTROLLER STARTS MOVING MOTOR BASED ON VELOCITY AND DISTANCE VALUES RECEIVED FROM MAIN CONTROLLER
406
MAIN CONTROLLER DETECTS MOTOR MOVING AND OPENS OUTLET VALVE
408
READ PUMP CHAMBER PRESSURE
410
CALCULATE DISPENSE ERROR BASED ON PRESSURE WITHIN PUMP CHAMBER
412
CALCULATE NEW TOTAL DISPENSE DISTANCE=REQUESTED DISPENSE DISTANCE+CALCULATED DISPENSE ERROR
414
CALCULATE NEW MOTOR VELOCITY BASED ON NEWLY CALCULATED TOTAL DISPENSE DISTANCE
416
SEND COMMAND TO CHANGE MOTOR VELOCITY
418
MONITOR PUMP CHAMBER PRESSURE FOR ANY DECREASES (ESPECIALLY RAPID ONES). IF ANY ARE DETECTED, SEND AN ALARM TO THE MAIN PUMP CONTROLLER
HAS MOTOR REACHED FINAL POSITION OR FINAL TIME ?
420
NO
YES
422
STOP THE MOTOR
A
TO FIG. 4b

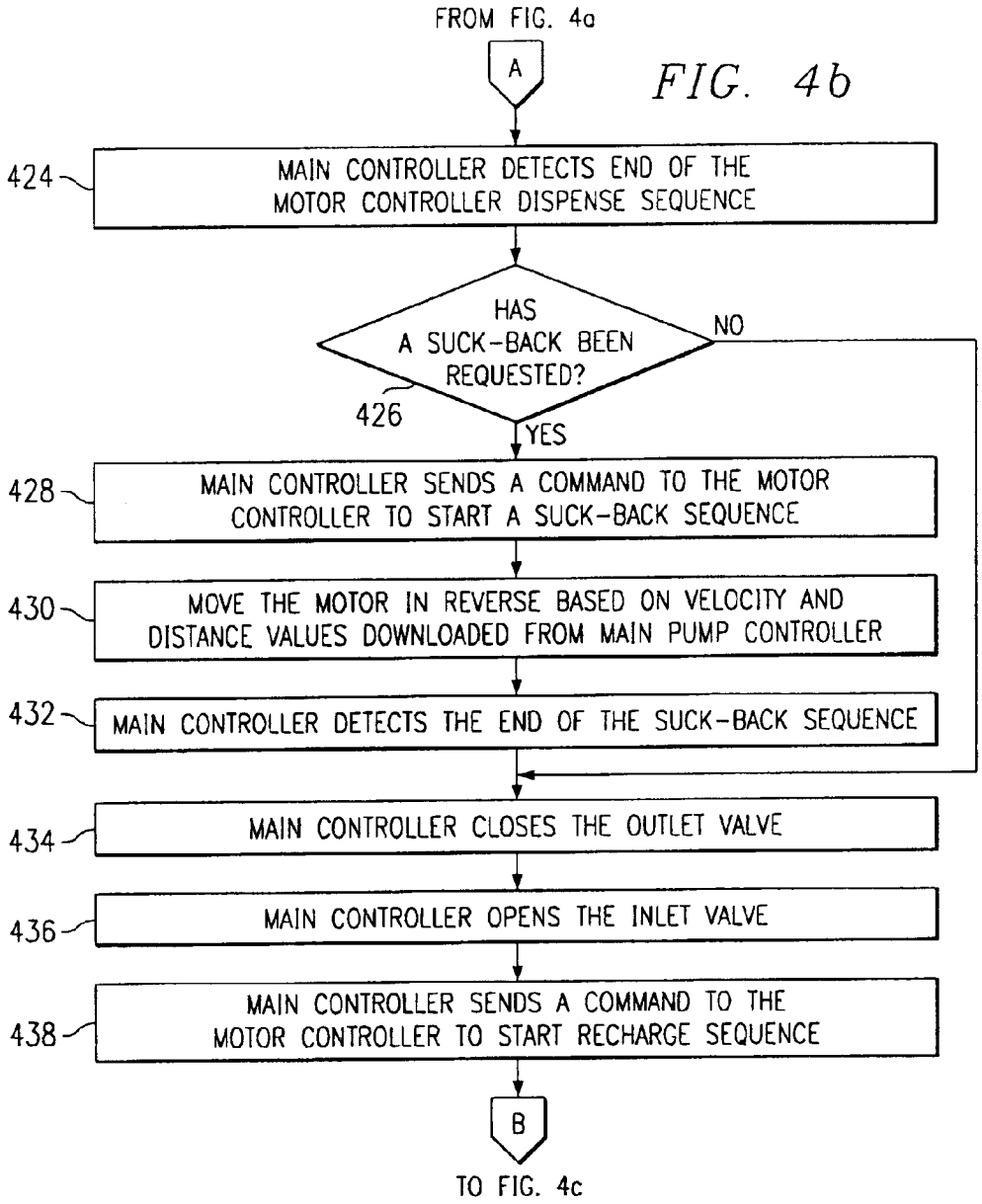
FROM FIG. 4a
A
FIG. 4b
424
MAIN CONTROLLER DETECTS END OF THE MOTOR CONTROLLER DISPENSE SEQUENCE
HAS A SUCK-BACK BEEN REQUESTED?
426
NO
YES
428
MAIN CONTROLLER SENDS A COMMAND TO THE MOTOR CONTROLLER TO START A SUCK-BACK SEQUENCE
430
MOVE THE MOTOR IN REVERSE BASED ON VELOCITY AND DISTANCE VALUES DOWNLOADED FROM MAIN PUMP CONTROLLER
432
MAIN CONTROLLER DETECTS THE END OF THE SUCK-BACK SEQUENCE
434
MAIN CONTROLLER CLOSES THE OUTLET VALVE
436
MAIN CONTROLLER OPENS THE INLET VALVE
438
MAIN CONTROLLER SENDS A COMMAND TO THE MOTOR CONTROLLER TO START RECHARGE SEQUENCE
B
TO FIG. 4c

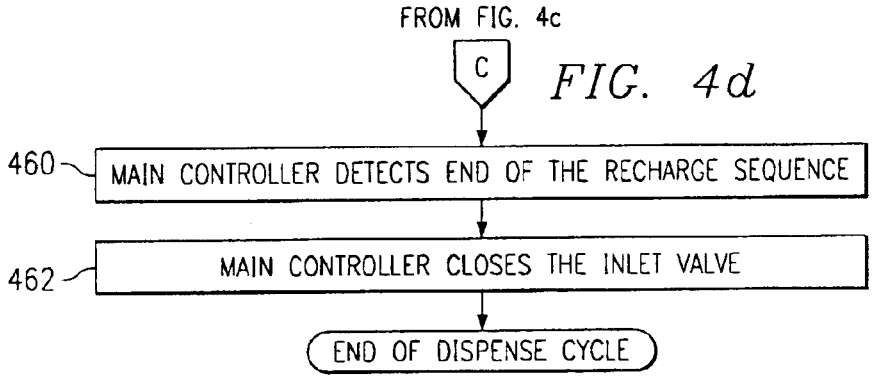
FROM FIG. 4c
C
FIG. 4d
460
MAIN CONTROLLER DETECTS END OF THE RECHARGE SEQUENCE
462
MAIN CONTROLLER CLOSES THE INLET VALVE
END OF DISPENSE CYCLE

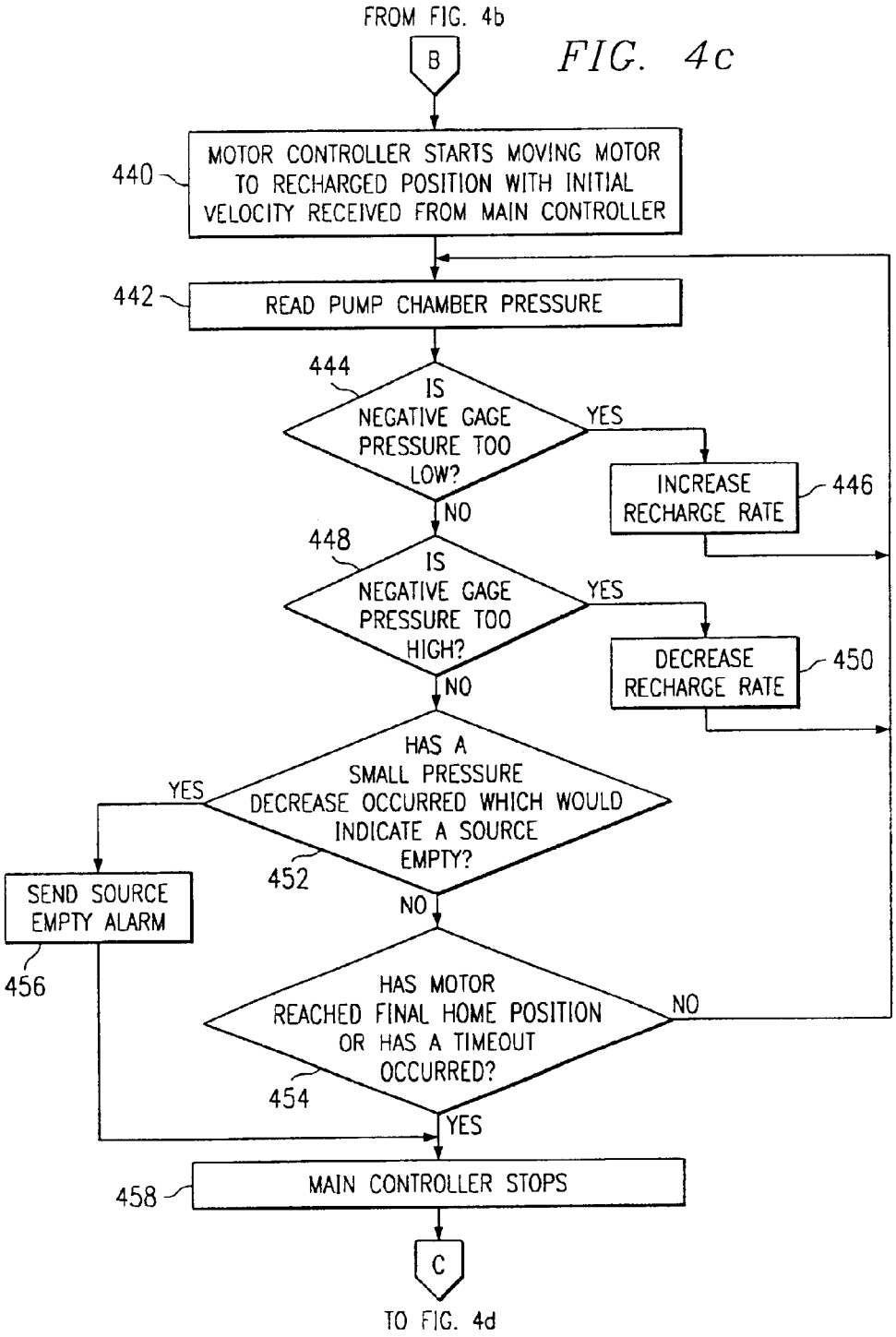
FROM FIG. 4b
B
FIG. 4c
440
MOTOR CONTROLLER STARTS MOVING MOTOR TO RECHARGED POSITION WITH INITIAL VELOCITY RECEIVED FROM MAIN CONTROLLER
442
READ PUMP CHAMBER PRESSURE
444
IS NEGATIVE GAGE PRESSURE TOO LOW?
YES
INCREASE RECHARGE RATE
446
NO
448
IS NEGATIVE GAGE PRESSURE TOO HIGH?
YES
DECREASE RECHARGE RATE
450
NO
HAS A SMALL PRESSURE DECREASE OCCURRED WHICH WOULD INDICATE A SOURCE EMPTY?
YES
452
SEND SOURCE EMPTY ALARM
456
NO
HAS MOTOR REACHED FINAL HOME POSITION OR HAS A TIMEOUT OCCURRED?
NO
454
YES
458
MAIN CONTROLLER STOPS
C
TO FIG. 4d

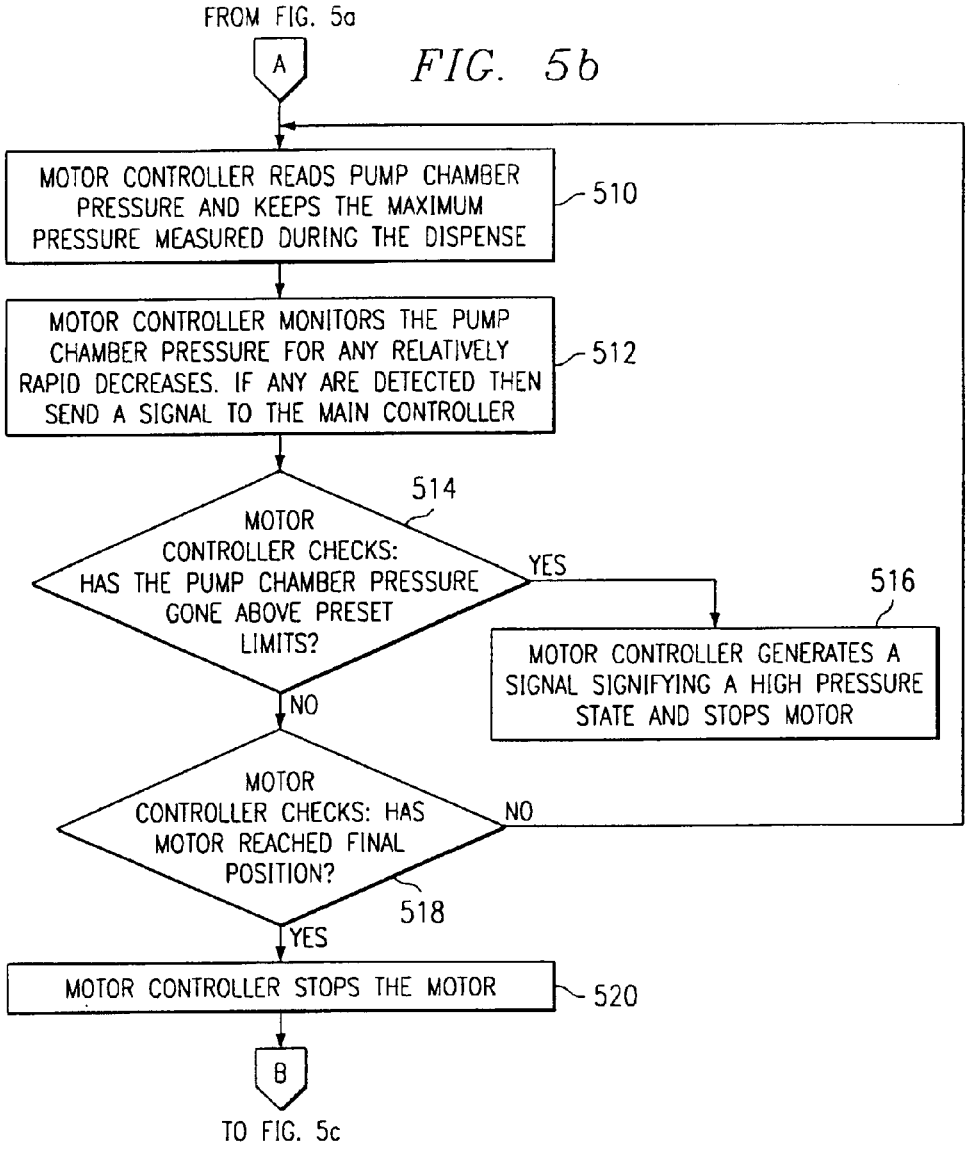
FROM FIG. 5a
A
FIG. 5b
MOTOR CONTROLLER READS PUMP CHAMBER PRESSURE AND KEEPS THE MAXIMUM PRESSURE MEASURED DURING THE DISPENSE
510
MOTOR CONTROLLER MONITORS THE PUMP CHAMBER PRESSURE FOR ANY RELATIVELY RAPID DECREASES. IF ANY ARE DETECTED THEN SEND A SIGNAL TO THE MAIN CONTROLLER
512
514
MOTOR CONTROLLER CHECKS: HAS THE PUMP CHAMBER PRESSURE GONE ABOVE PRESET LIMITS?
YES
516
MOTOR CONTROLLER GENERATES A SIGNAL SIGNIFYING A HIGH PRESSURE STATE AND STOPS MOTOR
NO
MOTOR CONTROLLER CHECKS: HAS MOTOR REACHED FINAL POSITION?
NO
518
YES
MOTOR CONTROLLER STOPS THE MOTOR
520
B
TO FIG. 5c

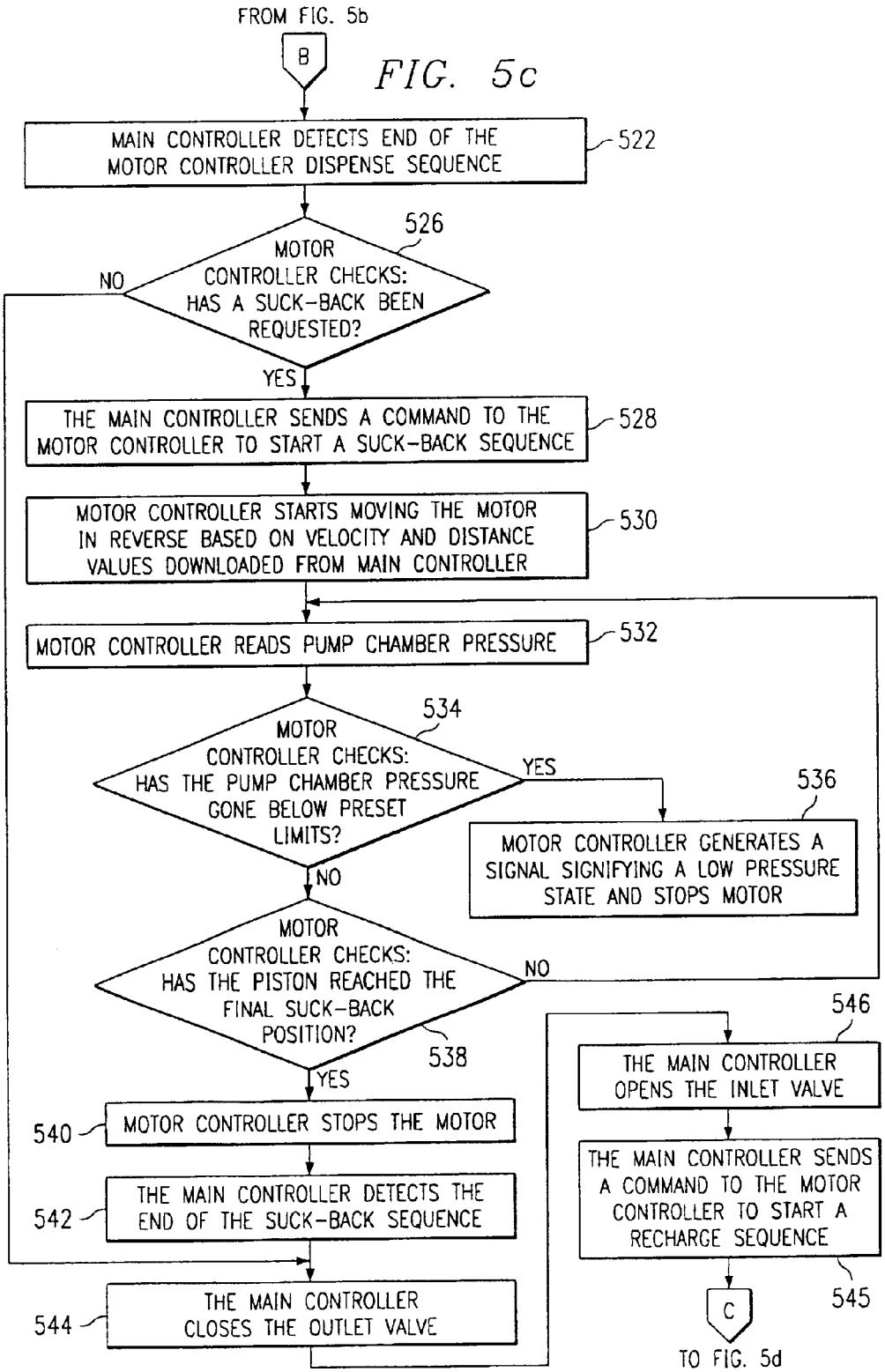
FROM FIG. 5b
B
FIG. 5c
MAIN CONTROLLER DETECTS END OF THE MOTOR CONTROLLER DISPENSE SEQUENCE
522
526
MOTOR CONTROLLER CHECKS: HAS A SUCK-BACK BEEN REQUESTED?
NO
YES
THE MAIN CONTROLLER SENDS A COMMAND TO THE MOTOR CONTROLLER TO START A SUCK-BACK SEQUENCE
528
MOTOR CONTROLLER STARTS MOVING THE MOTOR IN REVERSE BASED ON VELOCITY AND DISTANCE VALUES DOWNLOADED FROM MAIN CONTROLLER
530
MOTOR CONTROLLER READS PUMP CHAMBER PRESSURE
532
534
MOTOR CONTROLLER CHECKS: HAS THE PUMP CHAMBER PRESSURE GONE BELOW PRESET LIMITS?
YES
536
MOTOR CONTROLLER GENERATES A SIGNAL SIGNIFYING A LOW PRESSURE STATE AND STOPS MOTOR
NO
MOTOR CONTROLLER CHECKS: HAS THE PISTON REACHED THE FINAL SUCK-BACK POSITION?
NO
538
YES
546
THE MAIN CONTROLLER OPENS THE INLET VALVE
540
MOTOR CONTROLLER STOPS THE MOTOR
THE MAIN CONTROLLER SENDS A COMMAND TO THE MOTOR CONTROLLER TO START A RECHARGE SEQUENCE
542
THE MAIN CONTROLLER DETECTS THE END OF THE SUCK-BACK SEQUENCE
545
544
THE MAIN CONTROLLER CLOSES THE OUTLET VALVE
C
TO FIG. 5d

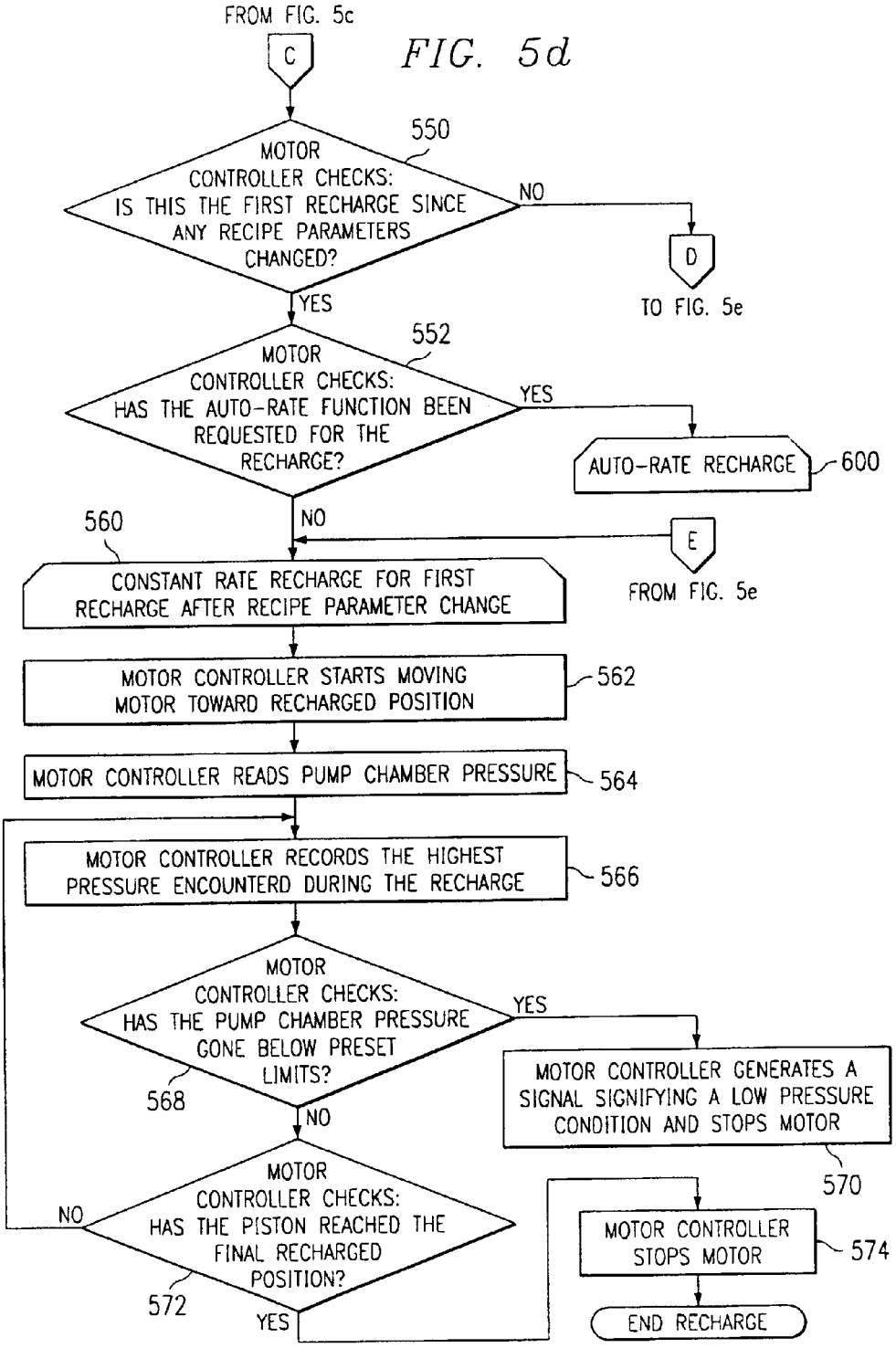
FROM FIG. 5c
C
FIG. 5d
550
MOTOR CONTROLLER CHECKS: IS THIS THE FIRST RECHARGE SINCE ANY RECIPE PARAMETERS CHANGED?
NO
D
TO FIG. 5e
YES
552
MOTOR CONTROLLER CHECKS: HAS THE AUTO-RATE FUNCTION BEEN REQUESTED FOR THE RECHARGE?
YES
AUTO-RATE RECHARGE
600
NO
560
E
FROM FIG. 5e
CONSTANT RATE RECHARGE FOR FIRST RECHARGE AFTER RECIPE PARAMETER CHANGE
MOTOR CONTROLLER STARTS MOVING MOTOR TOWARD RECHARGED POSITION
562
MOTOR CONTROLLER READS PUMP CHAMBER PRESSURE
564
MOTOR CONTROLLER RECORDS THE HIGHEST PRESSURE ENCOUNTERD DURING THE RECHARGE
566
MOTOR CONTROLLER CHECKS: HAS THE PUMP CHAMBER PRESSURE GONE BELOW PRESET LIMITS?
568
YES
MOTOR CONTROLLER GENERATES A SIGNAL SIGNIFYING A LOW PRESSURE CONDITION AND STOPS MOTOR
570
NO
MOTOR CONTROLLER CHECKS: HAS THE PISTON REACHED THE FINAL RECHARGED POSITION?
572
NO
YES
MOTOR CONTROLLER STOPS MOTOR
574
END RECHARGE

METHOD AND APPARATUS FOR DISPENSING FLUIDS

CROSS REFERENCE TO RELATED APPLICATIONS

The present application is a continuation of U.S. application Ser. No. 09/691,627 filed Oct. 18, 2000 (now U.S. Pat. No. 6,478,547) entitled "METHOD AND APPARATUS FOR DISPENSING FLUIDS", which is incorporated herein by reference, and which claims the benefit U.S. Provisional Patent Application No. 60/160,219 entitled "METHOD AND APPARATUS FOR DISPENSING HIGH VISCOSITY FLUIDS", filed Oct. 18, 1999, the disclosure of which is incorporated herein by reference.

BACKGROUND OF INVENTION

Many processes require accurate control over the amount and/or rate at which a fluid is dispensed by pumping apparatus. Both the rate and amount of processing fluid applied to, for example, a semiconductor wafer during fabrication of integrated circuits are very accurately controlled to ensure that the processing liquid is applied uniformly, and to avoid waste and unnecessary consumption. Many of the chemicals used in the semiconductor industry are toxic and very expensive. Accurate dispensing thus avoids toxic waste handling and reduces cost of fabrication. Contamination of process fluid in the form of air bubbles or particles or other external contamination must also be carefully controlled in many processes. Contamination in semiconductor device fabrication processes, for example, lowers yields and results in lost process fluid and production time.

For example, the manufacture of multi-chip modules (MCM), high-density interconnect (HDI) components and other semiconductor materials requires the application of a thin layer of polyimide material as an inner layer dielectric. The polyimide material must be applied with exacting precision because the required thicknesses of the polyimide film may be as small as 100 microns and the final thickness of the polyimide film must be uniform and not normally vary more than 2% across the substrate or wafer. In addition to the unique mechanical and electrical properties that make polyimides ideally suited for use in the manufacture of semiconductors, polyimides also have physical properties that make it difficult to pump or supply the polyimides in exacting amounts. Specifically, polyimides are viscous. Many polyimides used in the manufacture of semiconductors have viscosities in excess of 400 poise. Fluids with viscosities this high are difficult to pump and difficult to filter. It is not uncommon for polyimide fluids to cost in excess of $15,000 per gallon. Therefore, it is important that pump systems used to dispense the polyimide fluids dispense the exact amounts, without waste.

Fluid dispense systems in the prior art normally use positive displacement pumps to provide accurate metering of fluid. One type of positive displacement pump sometimes used in prior art is a bellows-type pump, an example of which is disclosed in U.S. Pat. No. 4,483,665. In a typical bellows pump, fluid to be pumped enters a hollow tubular bellows through a one-way check valve. Usually, the discharge end of the bellows is constrained from movement, while the other end is connected to a reciprocating mechanical member that selectively works the bellows for longitudinal expansion and contraction. When contracted, fluid is expelled or pumped from the bellows under pressure. One problem with a bellows pump is that, at high pumping pressures, considerable internal pressure is exerted on the bellows which, together with flexing during expansion and contraction, can result in fatigue and rupture of the bellows. Furthermore, the bellows will flex under pressure, causing a loss in the accuracy. To overcome this problem, fluid is pumped into a chamber surrounding the bellows to balance at least partially the pressure of the process fluid within the bellows. Another problem with bellows is that the pleats or convolutions in the bellows make it difficult to purge completely air or chemicals from the bellows. Air remaining in the bellows can create undesirable air bubbles.

A diaphragm-type positive displacement pump overcomes some of the problems associated with a bellows type of pump. A diaphragm pump has a diaphragm that divides a pumping chamber into in two sections. A working fluid is pumped into and out of one section of the chamber to cause the diaphragm to move back and forth, thereby forcing process fluid to be drawn into and pushed out of the other half of the chamber. If the change in the volume of the working fluid within the chamber is accurately known, the volume of the process fluid within the chamber can also be known accurately, thus allowing for accurate metering. Diaphragm pumps are therefore often actuated by incompressible hydraulic fluid to achieve very accurate control over movement of the diaphragm. Examples of diaphragm pumps are disclosed in U.S. Pat. Nos. 4,950,134, 5,167,837, 5,490,765, 5,516,429, 5,527,161, 5,762,795, and 5,772,899.

However, should a hydraulically actuated diaphragm fail, such as by developing a hole, hydraulic fluid may be forced into process fluid. This contamination then flows downstream, for example into other systems or onto, for example, semiconductor substrates that are then, in turn, processed, thus contaminating other systems down the production line. Furthermore, when servicing these systems hydraulic fluid may be tracked through a "clean room" environment on tools, gloves and other equipment, potentially contaminating the clean room. To avoid possible contamination by hydraulic fluid, the diaphragm could be pneumatically actuated. However, the compressibility of air makes accurate control of the dispense volume more difficult.

Another type of well known positive displacement pump is a rolling membrane pump. A rolling membrane pump includes a reciprocating piston that displaces fluid within a pumping chamber. Unlike piston-type pumps that have a moving seal between the piston and the pumping chamber walls, a flexible membrane is attached to the piston and to the side walls of the chamber to prevent fluid from escaping between the walls and the piston. As the piston moves, the membrane rolls up and down the side of the pump. However, the membrane flexes stretches under high pressures. Many of the process fluids that must be dispensed in semiconductor fabrication processes are highly viscous, and must be pumped at very high pressures. Presumably, for this reason it does not appear to have been used in prior art systems for accurately dispensing small quantities of liquid, particularly those in fabrication processes of semiconductor devices.

SUMMARY OF INVENTION

The invention provides for an improved precision fluid dispensing apparatus and method that solves on or more of the problems found in the prior art. More particularly, the invention avoids use of hydraulic fluid as a working medium to pump process fluids, thereby reducing risk of contamination to the process fluid and production environment, and overcomes problems associated with other types of positive displacement pumps to provide for accurate fluid dispensing.

According to one aspect of an exemplary embodiment of the invention, the problems with using a rolling membrane pump to meter accurately process fluid are overcome. The change in volume in a pumping chamber of the rolling membrane pump due to stretching is predicted to an acceptable degree as a function of pressure within the pumping chamber. The pressure of the process fluid within the chamber is monitored throughout a displacement stroke, and the distance of the displacement stroke necessary to deliver a preselected quantity of process fluid updated throughout the stroke to take into account and correct for the flexing and stretching of the membrane. The risk of contamination of process fluid is substantially reduced by not using hydraulic fluid to work a diaphragm for pumping process fluids, relying instead on a solid mechanical actuator of a membrane. Furthermore, unlike prior art bellows pumps, a rolling membrane pump has no convolutions and thus can be easily purged and cleaned.

According to another aspect of a preferred embodiment of the invention, a high precision dispensing system is made easier to maintain by use of a rolling membrane pump head that is coupled to a mechanical actuator powered by an electric motor that may be easily disconnected. Thus, the entire fluid path, consisting of the pumping chamber, chamber body, rolling membrane, a displacing mechanism, such as a piston, valves and fluid connections may be easily removed from a clean room environment for servicing without disturbing the mechanical actuator and controller. A second, clean pump head may thus be installed allowing the system to be returned to operation very quickly. The pump head may also be easily cleaned and reinstalled. The internal shape of the rolling membrane allows for it to be flushed rapidly. Thus, costly down time in a production facility can be avoided. Similarly, separation of the pump head from the drive mechanism allows the drive mechanism to be easily serviced and replaced, if necessary. Since the process fluid path would not be disturbed, there would be no fluid loss or purging required to remove air from the process fluid flow path.

Another advantage to the invention is that it is capable of being used with a wide range of process fluids, having very low viscosity (on the order of 1 to 2 centipoise) to very high viscosity (over 300 poise). Examples of such process fluids include, but are not limited to, solvents, resists, spin on glass (SOG), polyimides, low dielectric and many other chemistries used in semiconductor device fabrication processes. Although well suited for semiconductor device processing applications, the invention may be used in other applications.

In the preferred embodiment, the method comprises calculating an amount by which to change a dispense based at least in part on a predicted membrane flex if a particular dispense is other than a first dispense, wherein said predicted membrane flex is based at least in part on a maximum pump chamber pressure during the first dispense; calculating an amount by which to change a dispense based at least in part on a shape of the membrane if a particular dispense is a first dispense; moving a piston in the pumping system based at least in part on the calculated amount; opening an output valve of the pumping system; monitoring the pump chamber pressure to detect a sudden decrease in said pump chamber pressure to signal a mechanical failure in the pumping system; and determining a maximum pressure in the pump chamber during the movement of the piston.

Following is a detailed description of an exemplary embodiment of the invention, made in reference to the appended drawings.

BRIEF DESCRIPTION OF DRAWINGS

In the appended drawings.

FIGS. 4*a,* 4*b,* 4*c* and 4*d* are flow diagrams representing a preferred embodiment dispense process for the fluid dispense system of FIG. 1.

DETAILED DESCRIPTION

Figure 1:
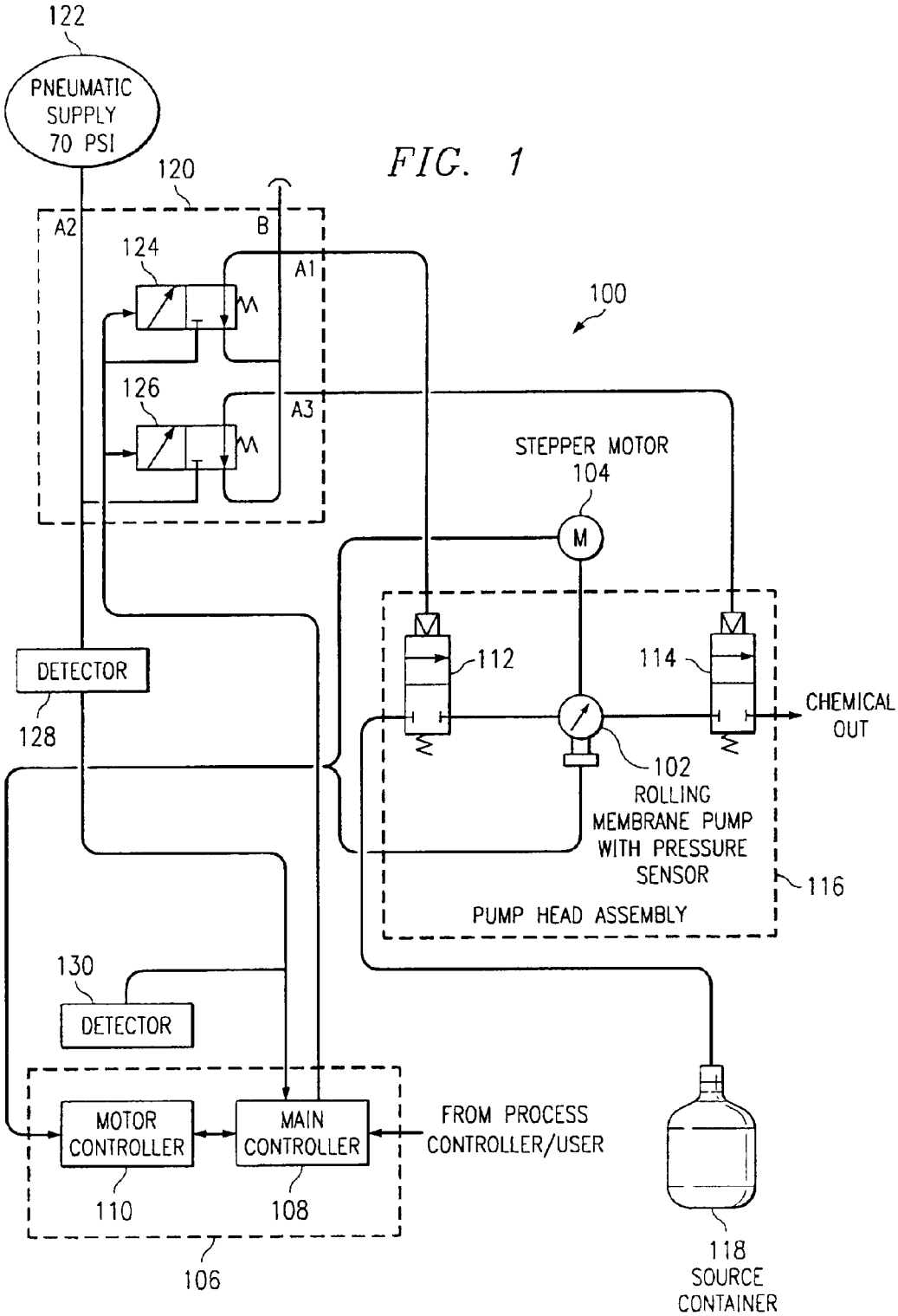
FIG. 1 is schematic diagram of a fluid dispensing system.

Referring to FIG. 1, dispense system 100 includes a rolling membrane, positive displacement pump 102 powered by an electric motor 104. Incorporated into the pump is a pressure sensor 111. An inlet to the chamber of pump 102 is connected to an inlet valve 112, and an outlet of the chamber of the pump is connected to outlet valve 114. The pump and two valves will be referred to as a pump head assembly 116. The inlet valve is coupled through a line to source of process fluids, which is indicated in the schematic as a bulk supply container 118. The outlet valve is coupled to process machinery requiring the fluid.

The inlet and outlet valves are pneumatically actuated. Pneumatic valve controller 120 actuates the valves, which are biased to a normally closed position, by connecting pressured air from pneumatic source 122 to the inlet or outlet valve. The pneumatic valve controller 120, in response to signals from controller 106, operates solenoid-controlled pneumatic valves 124 and 126 to open, respectively, inlet valve 112 and outlet valve 114. Detector 128 senses when the pneumatic supply has insufficient pressure to operate properly the inlet and outlet valves. Detector 130 senses process fluid leaking from the pump 102.

Motor, 104, pneumatic valve controller 120, pressure sensor 111, detector 128, detector 130 are in communication with a controller 106. The controller and communications medium is not limited to any particular form. For example, the controller can be microprocessor-based and programmable. In the illustrated embodiment, the controller is comprised of a main controller 108, which is programmable and microprocessor-based, and a programmable motor controller 110. Main controller 108 controls all of the functions of dispense system except direct motor control. It is connected to a computer or other controller that provides process control in information indicating what amount or volume of process fluid is to be dispensed, and the time in which, or rate at which, the dispensing must occur. The main controller converts this information into corresponding displacement and velocity values for pump 102, and communicates this information to motor controller 110. The motor controller then instructs the motor 104 to move according to the specified distance and velocity, correcting for deformation of a rolling membrane attached to a displacing mechanism, such as a piston within pump 102, based on the output of pressure sensor 111, in a manner to be subsequently described.

Figure 2A:
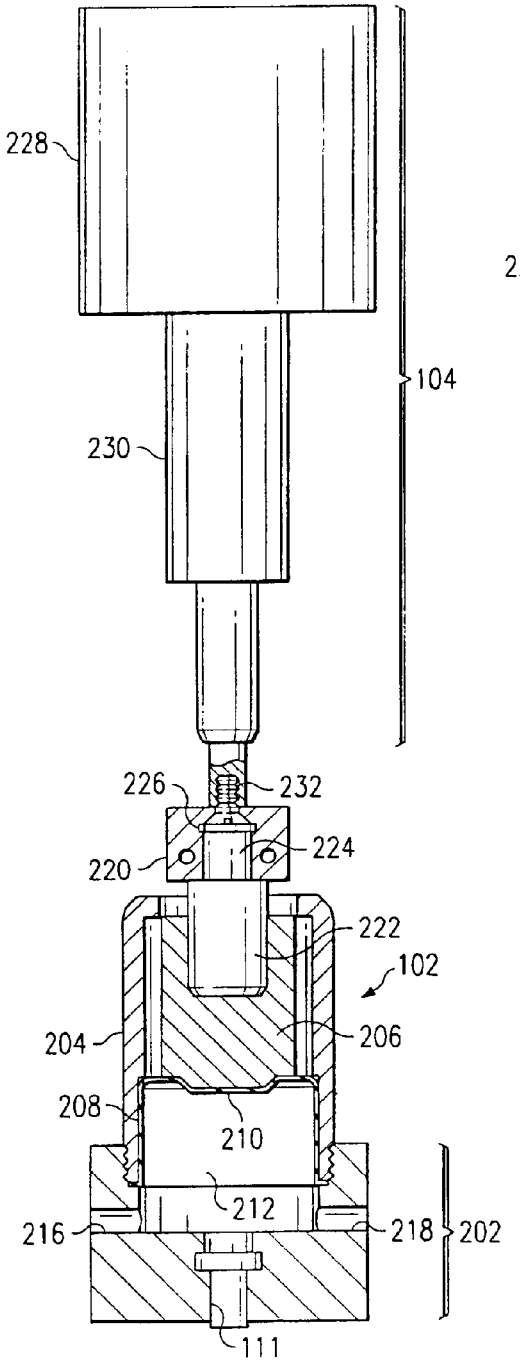
FIG. 2*a* is a schematically illustrated motor and pump, which shown in partial section, used in the dispense system of FIG. 1.
Figure 2B:
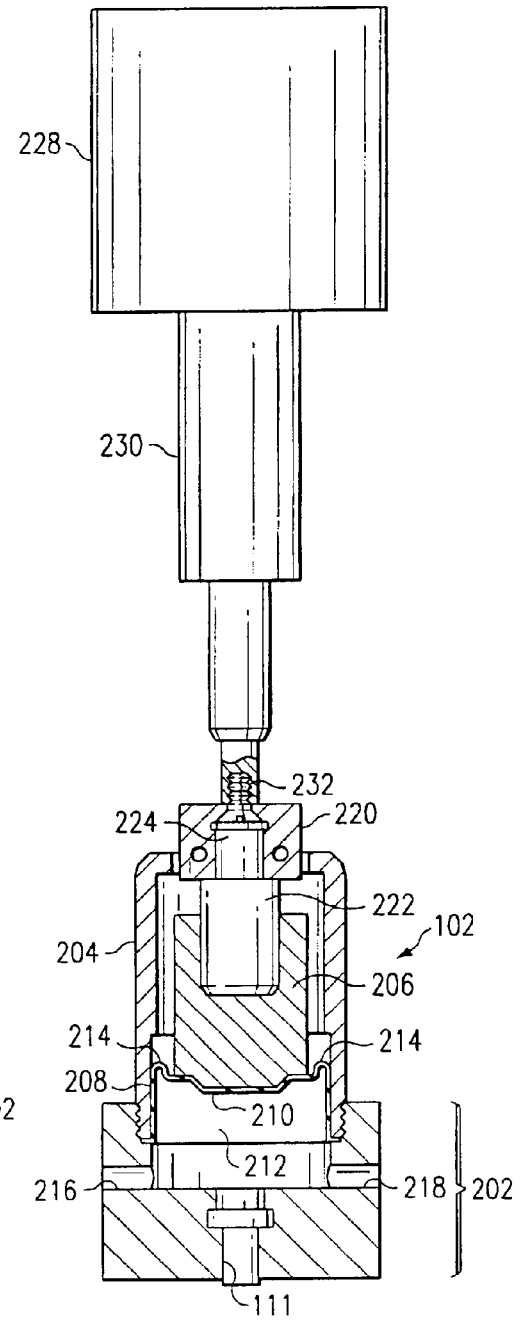
FIG. 2*b* is a schematically illustrated motor and pump, which is shown in partial section, used in the dispense system of FIG. 1.

Referring now to FIGS. 2*a,* 2*b* and 2*c,* pertinent details of the pump 102 and motor 104 are schematically illustrated, with the pump being shown in section. The pump's housing is comprised of a base 202 and a cover 204. Disposed within the cover is a solid or rigid piston 206. A flexible membrane 208 is attached to the face 210 of the piston. The membrane extends from the face and attaches to the inside wall of the pump housing to define a pumping chamber 212. In a preferred embodiment, the membrane and piston of formed from a single, unitary piece of Teflon®. The Teflon does not react with fluids used in most semiconductor device fabrication processes. When the piston is in a fully retracted position, as shown in FIG. 2*a;* the membrane is formed and attached to the piston in way that tends to press it against the inside walls of the housing. This ensures that the membrane will roll onto and off of the piston as the piston moves in and out of the pumping chamber. FIG. 2*b* illustrates the piston in a partially descended position, with the membrane having a neatly formed roll 214 surrounding the face 210 of the piston. The pumping chamber has an inlet opening 216, through which process fluid will be drawn after it passes through the inlet valve 112 (FIG. 1), and an outlet opening 218, through which process fluid will be exist for dispensing upon the opening of the outlet valve 114 (FIG. 1).

Figure 2C:
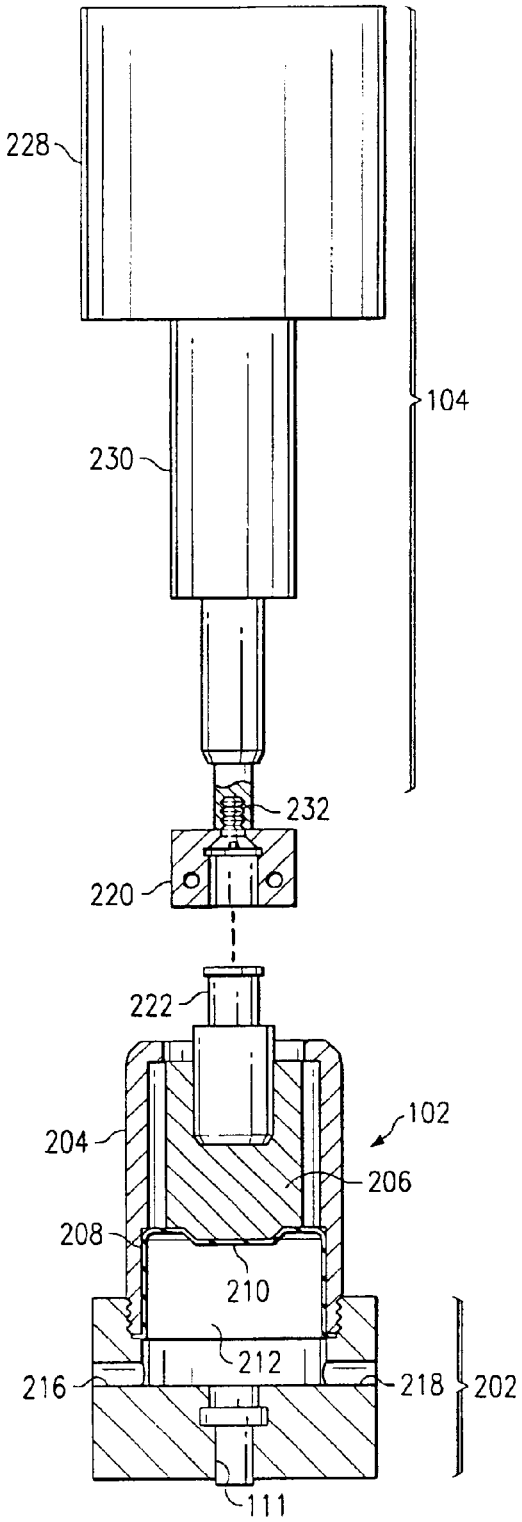
FIG. 2*c* is a schematically illustrated motor and pump, which is shown in partial section, used in the dispense system of FIG. 1.
Figure 3:
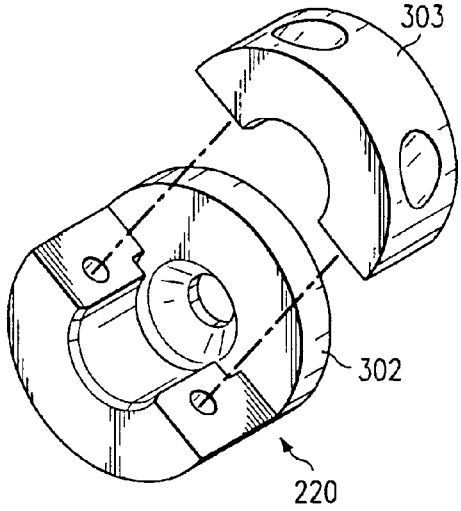
FIG. 3 is a perspective drawing of a coupling for a connecting the motor and pump shown in FIGS. 2*a,* 2*b* and 2*c*.
Figure 5A:
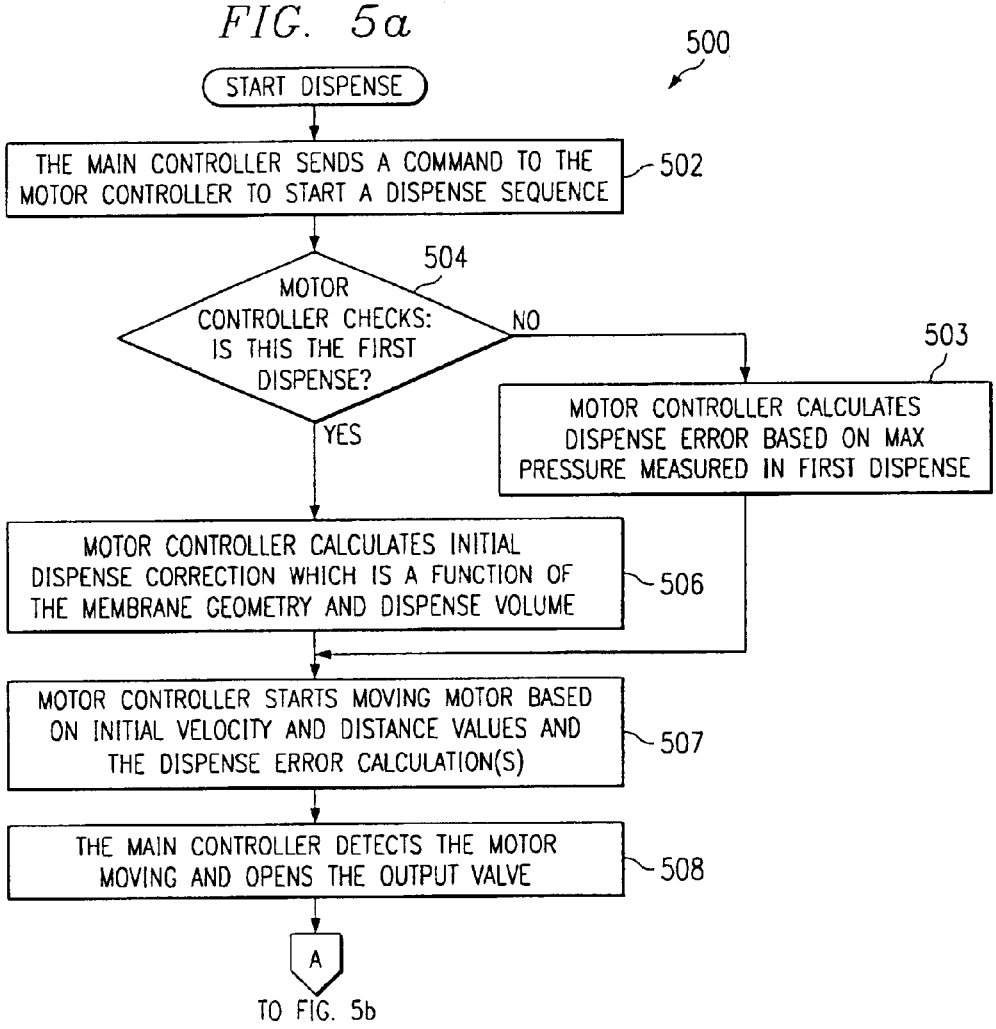
FIGS. 5*a,* 5*b,* 5*c,* 5*d* and 5*e* are flow diagrams representing an alternative embodiment dispense process for the fluid dispense system of FIG. 1.
Figure 5E:
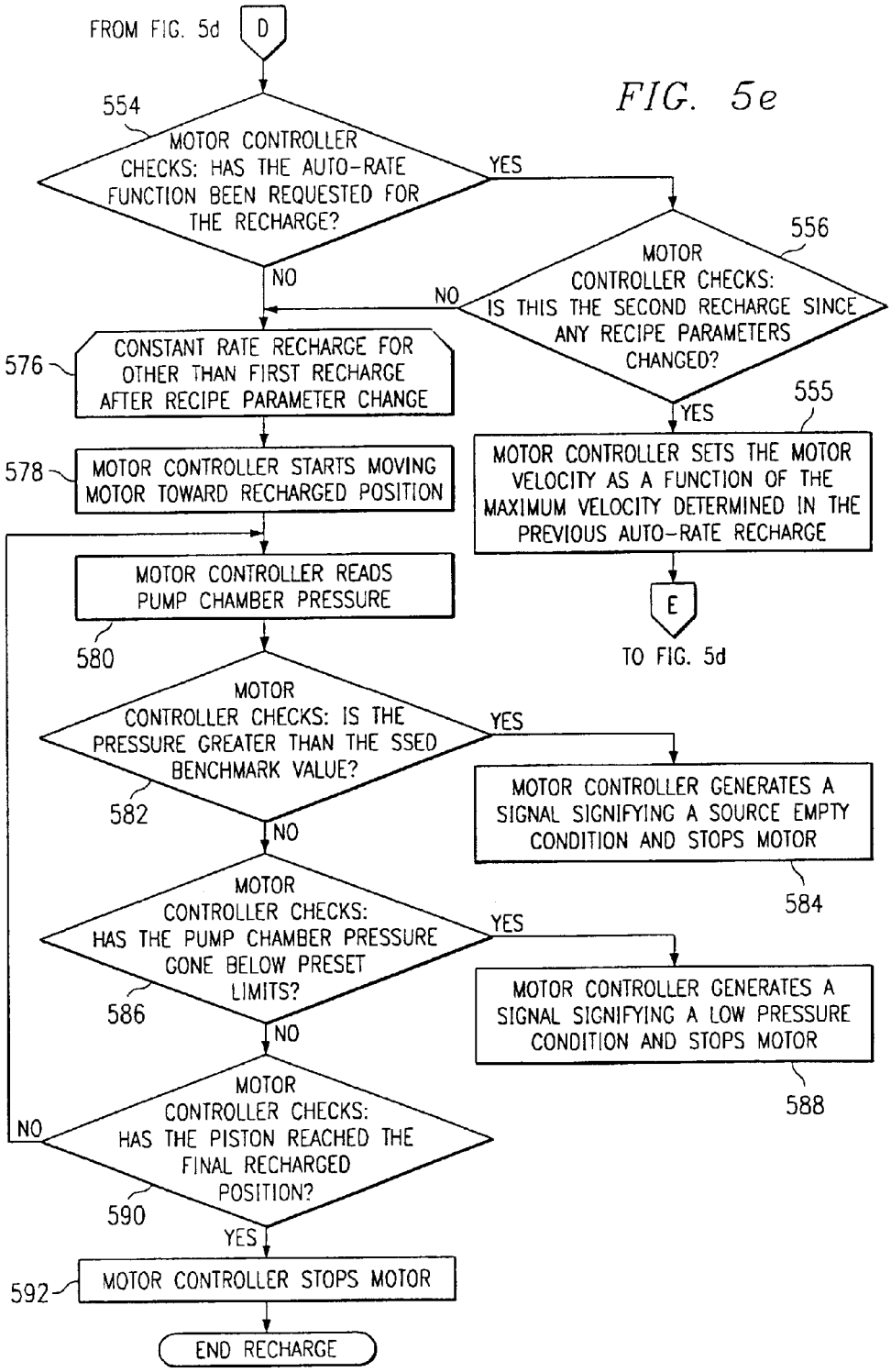

The piston 206 is connected to motor 104 by means of a releasable coupling 220, that permits the motor to be easily separated from the pump head for servicing of the pump head or the motor, as shown in FIG. 2*c.* The motor, whose mounting is not shown, has an output that moves in a reciprocating manner to pump the piston. The releasable coupling includes a base 302 that attaches to the motor, and removable piece 303, both of which are shown in FIG. 3. The coupling fits around a head portion 224 of mandrel 222 like a collar. With the removable piece removed, the head of the mandrel can be slipped into the base of the coupling. The two pieces are joined together by screws (not shown). To make a strong, reliable connection, the head portion of the mandrel is circumscribed by a ridge that fits within a grove formed on the inside surfaces of the coupling.

The motor includes, in its preferred form, a stepper motor 228 that has a rotational output. To convert the rotational output of the motor movement to a linear, reciprocating movement, a linear actuator 230 couples the output of the stepper motor to the pump. The fastener 220 is connected to the output mandrel of the linear actuator 230 by means of threaded member 232. However, it could be attached in other ways.

Referring now to FIG. 4, with further reference to FIGS. 1 and 2*a,* 2*b* and 2*c,* the dispense cycle is commenced at step 402 by the main controller 108 (FIG. 1) sending a command to the motor controller 110 (FIG. 1) and providing the motor controller with values indicating an initial or baseline distance the piston 206 (FIG. 2*a*) within the pump is to be displaced and an initial velocity at which it is to be displaced. This distance the piston is to be moved is a function of the amount of process fluid to be dispensed. It is calculated based on the known volume that the piston will displace as a function of the distance without any pressure within the chamber that may cause deformation of the membrane 208 (FIG. 2). The velocity is a function of the rate, or the time in which the dispense must take place and the amount to be dispensed. The dispense command might be sent in response to the main controller, for example, receiving a request from a production process controller or user. The request may specify a certain amount of process fluid and, optionally, a particular dispense rate or time. Alternately, the amount and rate may be programmed in the main controller. The dispense cycle need not commence with the piston at a particular location, so long as there is a sufficient displacement distance available to make the dispense. However, upon powering up of the dispense system, the piston is withdrawn to a fully retracted position, as shown in FIG. 2*a.*

Upon receiving the dispense command, the motor controller, at step 404, causes the motor to advance the piston at the requested velocity. Once the main controller detects that the motor is moving, it opens outlet valve 114 (FIG. 1) at step 406. At step 408, the motor controller begins an error correction loop by reading pump chamber pressure sensor 111 (FIG. 1). This loop is repeated throughout the displacement stroke of the pump. During the loop, the displacement distance for the piston is constantly updated to correct for stretching of the membrane 208 (FIG. 2). The membrane, which is preferably made of flexible Teflon, will tend to expand or deform as the chamber pressure increases, especially at high pressures. As a result, fluid which would be expected to exit the chamber as a result of a certain displacement of the pump moves does not, in fact, exit the pumping chamber 212 (FIG. 2). A small portion of the fluid is instead forced into the space created by the expanding diaphragm. Dispense error is can be reasonably well approximated as a function of the requested total dispense volume, which is related to the piston advance distance, and the chamber pressure. The chamber pressure during any given dispense is a function of the pump dispense rate and the viscosity of the fluid being dispensed. However, in the preferred embodiment, sensor 111 (FIG. 1) is used to measure the actual pressure within the pumping chamber 212. A dispense error can therefore be calculated, as both variables are known. However, the total expected time for the dispense can be estimated prior to starting the dispense to determine the most efficient way to monitor the chamber pressure and calculate corrections for the dispense error.

At step 410, a dispense error is calculated. In the preferred embodiment, the dispense error is modeled as a function of the pressure within the chamber, as measured by the pressure sensor 111. An equation used for the calculation of the error is, in one preferred embodiment, a second order polynomial $Ax^2+Bx+C$, where x is the pressure and the coefficients A, B and C are determined by fitting the equation to empirical data collected from tests that compare expected to amounts that are actually dispensed by the pump, and correlating it to the maximum chamber pressure during dispense. This approximation has been found to provide good results, and provides sufficient accuracy for most current semiconductor device fabrication applications. Once the expected dispense error is calculated a new, updated value for the final motor position, which is a function of the starting position and updated displacement distance, is calculated at step 412 that will compensate for the error. At step 414, a new or updated advance rate for the piston is calculated so that the total dispense time, after adjustments made for the increased displacement of the piston, will be the same as the rate or time originally requested. The motor controller the determines the motor velocity necessary to achieve this advance rate and issues appropriate instructions at step 416.

The pressure within the pump chamber is checked again at step 418 for a sudden drop in pressure that may indicate a problem. If there is such a drop, an alarm is sent to the main controller. During a typical dispense, the pressure within the pumping chamber will vary, except for an initial drop when the outlet valve 114 (FIG. 1) opens, in a relatively smooth manner. If a mechanical component of the motor or other system driving the pump begins to fail, the chamber pressure during a dispense will likely begin to fluctuate at a higher frequency and with larger amplitude than normal. Therefore, the drive system failures can be detected before they become a serious problem to the user by monitoring the pumping chamber pressure for potentially sharp decreases after the initial decrease when the outlet valve is opened.

This process loops back to step 408 unless, at decision step 420, the motor has reached its final position or the time for the dispense has elapsed. Depending on the amount of process fluid to be dispensed, the loop may occur hundreds of times during a dispense. If the motor has reached its final position or the dispense time has elapsed, the motor is stopped by the motor controller at step 422.

As indicated by step steps 424 and 426, the main controller, once it detects the end of the motor controller dispense sequence will, depending on whether "suck-back" has been requested by a user or process, cause the motor to initiate a suck back sequence at step 428, or jump to step 434 and close the outlet valve 114 (FIG. 1). The suck back sequence refers to retracting or reversing the travel of the piston 206 within the pump 102 (FIG. 2) to cause fluid within a tip or nozzle of the dispenser outlet to retreat far enough into the tip or nozzle to reduce dripping or drying of the fluid. At step 430, the motor controller 110 causes the motor 104 (FIG. 1) to move the piston of the pump in a reverse direction based on velocity and distance values communicated from the main controller 108. A user sets these values depending on the process fluid.

Once the main controller 108 (FIG. 1) detects the end of the suck-back sequence at step 432, it closes the outlet valve 114 at 434 and begins a recharge process. During the recharge process, process fluid is drawn into the pumping chamber 212 (FIG. 2) from the fluid source container 118. The recharge process need not be undertaken after every dispense, depending on process requirements. At step 436, the main controller opens inlet valves 111 and sends, at step 438, instructions to the motor controller to start a recharge sequence. The recharge sequence starts the motor moving, at step 440, towards a recharged or fully retract position, which is shown in FIG. 2*a*. It does so at an initial velocity received from the main controller 108. With step 442, a monitoring loop begins. Due to the flexible nature of the membrane 208 (FIG. 2), a negative gauge pressure, which is the difference between atmospheric pressure and the pressure within the chamber, that is too high will cause the membrane to collapse inwardly, toward the center of the pump chamber. This results in deformation of the membrane that requires repairing the pump. Therefore, at step 444, the gauge pressure, which is negative, is checked. If the magnitude of the gauge pressure is low, based on a predetermined minimum value for an acceptable range of operation, the recharge rate can be increased at step 446 by increasing the velocity of the piston 206 (FIG. 2) in pump 102. If, at step 448, the magnitude of the negative gauge pressure is too high, based on a maximum value for an acceptable range of operation, the recharge rate needs to be decreased at step 450 by decreasing the velocity of the piston to avoid collapsing the membrane.

At step 452, the motor controller also monitors the changes in pressure within the pumping chamber measured by the pressure sensor 111. During a typical recharge, the chamber pressure remains relatively constant at some negative gauge pressure. The only time that the chamber pressure would be expected to change significantly during a recharge is if the source bottle becomes empty and air is drawn into the line. Furthermore, during successive recharges the negative gauge pressure in the chamber will tend to decrease as more air is drawn into the line at the source. The chamber pressure is therefore monitored during a recharge or successive recharges for decreases in the negative gauge pressure, or an increase in absolute pressure, to determine if the process fluid source container is empty. Monitoring over successive recharges may be required if the distances that the piston moves in a given recharge sequence does not allow for enough time to detect a gauge pressure decrease within a single recharge. If a source empty condition is detected at step 452 by the motor controller, the recharge is halted by stopping the motor at step 458 and an alarm sent to the main controller at step 456, which in turn alerts the user. This source empty detection method has at least one advantage over a conventional mechanical bubble sensor placed near the source, in that, unlike such a sensor, it does not frequent mechanical adjustment. Second, since bubble sensors have moving parts, they will tend to fail more often. Otherwise, the recharge process continues until the motor has reached a predetermined final position, which may be a fully retracted "home" position as shown in FIG. 2*a* or some other predetermined position, or until some elapsed time has occurred. For example, if the recharge is occurring between known dispense processes, the recharge time may be set for the time between the dispense cycles. Alternately, the recharge sequence can be stopped upon receiving a dispense request. Once the main controller detects the end of the recharge sequence at step 460, it closes the inlet valve 111 (FIG. 1) at step 462.

FIGS. 5*a*, 5*b*, 5*c*, 5*d* and 5*e* are flow diagrams representing an alternative embodiment dispense process for the fluid dispense system of FIG. 1. Referring to FIG. 5 with further reference to FIGS. 1 and 2*a*, 2*b* and 2*c*, the dispense cycle is commenced at step 502 by the main controller 108 (FIG. 1) sending a command to the motor controller 110. In step 504 a determination is made as to whether the command is for a first dispense. If the command is not for a first dispense, then in step 503, a dispense error is calculated. In the preferred embodiment, the dispense error is modeled as a function of the maximum pressure within the chamber, as measured by the pressure sensor 111, during the first dispense. An equation used for the calculation of the error is, in one preferred embodiment, a second order polynomial $Ax^2+Bx+C$, where x is the pressure and the coefficients A, B and C are determined by fitting the equation to empirical data collected from tests that compare expected to amounts that are actually dispensed by the pump, and correlating it to the maximum chamber pressure during dispense. This approximation has been found to provide good results, and provides sufficient accuracy for most current semiconductor device fabrication applications. The membrane flexes and expands in a predictable way that is predominantly a function of the pump chamber pressure and the dispense error provides the amount by which to change the dispense based on the predicted membrane flex.

In step 506, the motor controller calculates an initial dispense correction which is preferably a function of the diaphragm geometry and the dispense volume. The initial dispense correction can be measured empirically and is preferably based on an understanding of the mechanical behavior of the membrane. An equation used for the calculation of the error is, in one preferred embodiment, a second order polynomial $Ax^2+Bx+C$, where x is the dispense distance and the coefficients A, B and C are determined by fitting the equation to empirical data collected from tests that compare expected to amounts that are actually dispensed by the pump, and correlating it to the dispense distance.

In step 507, the motor controller causes the motor to advance the piston based on one or more of the following factors: velocity, distance, dispense correction value, and/or the like. The velocity is preferably a function of the rate or the time in which the dispense is to take place and the amount to be dispensed. The dispense command might have been sent in response to the main controller, for example, receiving a request from a production process controller or user. The request may specify a certain amount of process fluid and, optionally, a particular dispense rate or time. Alternately, the amount and rate may be programmed in the main controller. The distance the piston is to be moved is preferably a function of the amount of process fluid to be dispensed. It is calculated based on the known volume that the piston will displace as a function of the distance without any pressure within the chamber that may cause deformation of the membrane 208 (FIG. 2). The dispense cycle need not commence with the piston at a particular location, so long as there is a sufficient displacement distance available to make the dispense. However, upon powering up of the dispense system, the piston is withdrawn to a fully retracted position, as shown in FIG. 2*a*.

Once the main controller detects that the motor is moving, it opens outlet valve 114 in step 508. In step 510, the motor controller determines the pump chamber pressure by reading the pump chamber pressure sensor 111 (FIG. 1). In the preferred embodiment, the maximum pressure measured during the dispense is stored. Unlike, the method described with respect to the flow diagram of FIG. 4, the displacement distance for the piston is not constantly updated to correct for stretching of the membrane 208 (FIG. 2). In step 512, the pump chamber pressure is monitored to determine any relatively rapid decrease in the pump chamber pressure. In the event that a rapid decrease in pump chamber pressure is detected, a signal is sent to the main controller indicating detection of a mechanical fault. Thus, a mechanical fault in the pump may be detected by monitoring the pump chamber pressure for any rapid decrease. Accordingly, the method as described above allows the operator to be warned of an actual failure or a potential future failure allowing the operator to plan for repairs.

In step 514, a determination is made as to whether the pump chamber pressure is above a preset limit. If the pump chamber pressure is above a preset limit, then in step 516 a signal signifying a high pressure condition is generated and the motor is stopped. If the pump chamber pressure is not above the preset limit, then in step 518 a determination as made as to whether the motor has reached the final position. If the motor has not reached the final position then the process starting at step 510 is repeated. If the motor has reached its final position, the motor is stopped by the motor controller in step 520.

As indicated by steps 522 and 524, the main controller, once it detects the end of the motor controller dispense sequence will, depending on whether "suck-back" has been requested by a user or process, cause the motor to initiate a suck back sequence at step 526, or jump to step 544 and close the outlet valve 114 (FIG.1). The suck back sequence refers to retracting or reversing the travel of the piston 206 within the pump 102 (FIG. 2) to cause fluid within a tip or nozzle of the dispenser outlet to retreat far enough into the tip or nozzle to reduce dripping or drying of the fluid. At step 530, the motor controller 110 causes the motor 104 (FIG. 1) to move the piston of the pump in a reverse direction based on velocity and distance values communicated from the main controller 108. In the preferred embodiment, a user sets these values depending on the process fluid.

In step 532, the motor controller determines the pump chamber pressure by reading the pump chamber pressure sensor 111 (FIG. 1). In step 534, a determination is made as to whether the pump chamber pressure is below a preset limit. If the pump chamber pressure is below a preset limit, then in step 536 a signal signifying a low pressure state is generated and the motor is stopped. If the pump chamber pressure is not below the preset limit, then in step 538 a determination is made as to whether the piston has reached the final suck back position. In the preferred embodiment, pressure detection takes place continuously during movement of the piston. If the piston has not reached the final suck back position then the process starting at step 532 is repeated. If the piston has reached its final position, the motor is stopped preferably by the motor controller in step 540.

Once the main controller 108 (FIG. 1) detects the end of the suck-back sequence at step 542, it closes the outlet valve 114 at 544 and begins a recharge process.

During the recharge process, process fluid is drawn into the pumping chamber 212 (FIG. 2) from the fluid source container 118. The recharge process need not be undertaken after every dispense, depending on process requirements. At step 546, the main controller opens inlet valves 111 and sends, at step 548, instructions to the motor controller to start a recharge sequence.

FIG. 5*d* shows a flow diagram for the motor control recharge sequence. In step 550 a determination is made as to whether the current charge is a first recharge since any recipe parameters were changed. In the preferred embodiment, recipe parameters define various parameters, such as volume to be dispensed, dispense rate, time settings, and/or the like, for the dispense operation. For example, the recipe parameters may specify a dispense volume of three mL to be dispensed in two seconds, and a recharge time of four seconds.

In step 552 a determination is made as to whether an auto-rate function has been requested for the recharge. If an auto-rate function has been requested for the recharge, then in step 600, the auto-rate recharge is executed. The auto-rate recharge process is discussed herein with reference to the flow diagram of FIG. 6. If an auto-rate recharge function has not been requested then a constant rate recharge process for a first recharge after recipe parameter change (step 560) is executed.

In the preferred embodiment, if the current recharge is not the first recharge since any recipe parameters were changed, then in step 554 a determination is made as to whether an auto-rate function has been requested for the recharge. If an auto-rate function has been requested for the recharge, then in step 556, a determination is made as to whether the current recharge is a second recharge since any recipe parameters were changed. If the current recharge is a second recharge since any recipe parameters were changed then in step 558 the velocity of the motor is set as a function of the maximum velocity determined in the previous auto-rate recharge. A constant rate recharge process for a first recharge after recipe parameter change (step 560) is then executed.

Figure 7:
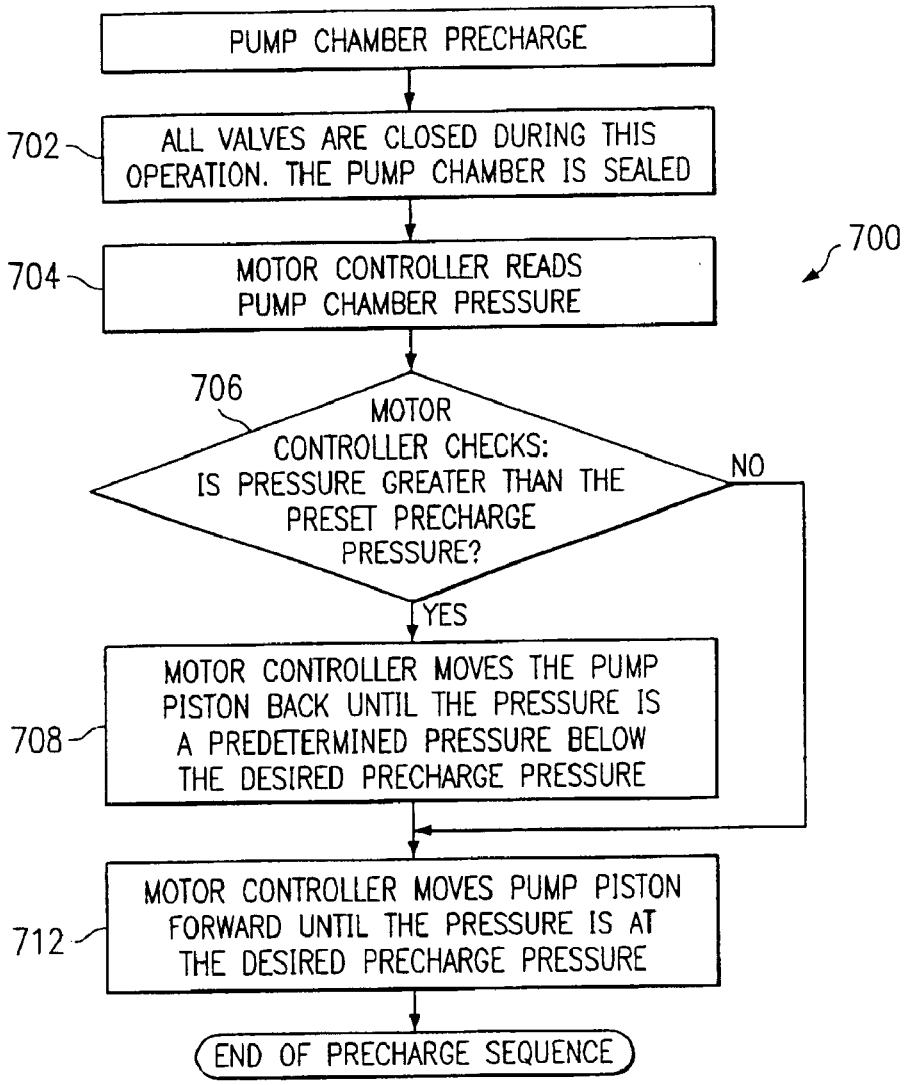
FIG. 7 is a flow diagram representing a preferred embodiment pump chamber precharge process for the fluid dispense system of FIG. 1.

In step 562, the motor controller causes the motor to move towards the recharged position. In step 564, the motor controller determines the pump chamber pressure by reading the pump chamber pressure sensor 111 (FIG. 1). In the preferred embodiment, in step 566, a determination is made as to whether the currently read pump chamber pressure is higher than any previously recorded pressure encountered during the recharge. If it is, then in the preferred embodiment, the value of the current pressure is recorded as a benchmark value for Software Source Empty Detection (SSED) to be used in subsequent dispenses as discussed hereinafter. In step 568, a determination is made as to whether the pump chamber pressure is below a preset limit. If the pump chamber pressure is below a preset limit, then in step 570, a signal signifying a low pressure condition is generated and the motor is stopped. If the pump chamber pressure is not below the preset limit, then in step 572 a determination is made as to whether the piston has reached the final recharged position. If the piston has not reached the final recharged position then the process starting at step 564 is repeated. If the piston has reached the final recharged position, the motor is stopped preferably by the motor controller in step 574. Once the motor is stopped, in the preferred embodiment, the pump chamber precharge process 700 as described herein with reference to FIG. 7 is performed.

If the current recharge is not the first recharge since any recipe parameters changed and an auto-rate function has not been requested for the recharge or if the current recharge is a second recharge since any recipe parameters changed, then a constant rate recharge for other than a first recharge since any recipe parameters changed (step 576) is executed. In step 578, the motor controller causes the motor to move towards the recharged position. In step 580, the motor controller determines the pump chamber pressure by reading the pump chamber pressure sensor 111 (FIG. 1). In the preferred embodiment, in step 582, a determination is made as to whether the currently read pump chamber pressure is greater than the SSED benchmark value plus an offset to prevent false alarms. The SSED benchmark relies on the recharge pressure being constant as the recharge rate is constant in a constant rate recharge. If the source bottle becomes empty during a recharge then the pressure will increase as air/gas is pulled into the chamber. Thus, if the currently read pump chamber pressure is greater than the SSED benchmark value plus the offset, then in the preferred embodiment, in step 584, a source empty alarm signal is generated and the motor is stopped. Thus, by comparing the pump chamber pressure with the SSED benchmark value the source can be monitored to determine if and when a source of the fluid becomes empty. Accordingly, in the preferred embodiment of the present invention, the reliance on calibration to determine when a source is empty is eliminated.

In step 586, a determination is made as to whether the pump chamber pressure is below a preset limit. If the pump chamber pressure is below a preset limit, then in step 588, a signal signifying a low pressure condition is generated and the motor is stopped. If the pump chamber pressure is not below the preset limit, then in step 590 a determination is made as to whether the piston has reached the final recharged position. If the piston has not reached the final recharged position then the process starting at step 580 is repeated. If the piston has reached the final recharged position, the motor is stopped preferably by the motor controller in step 592. In the preferred embodiment, once the motor has stopped the pump chamber precharge process 700 as described herein with reference to FIG. 7 is performed.

Figure 6:
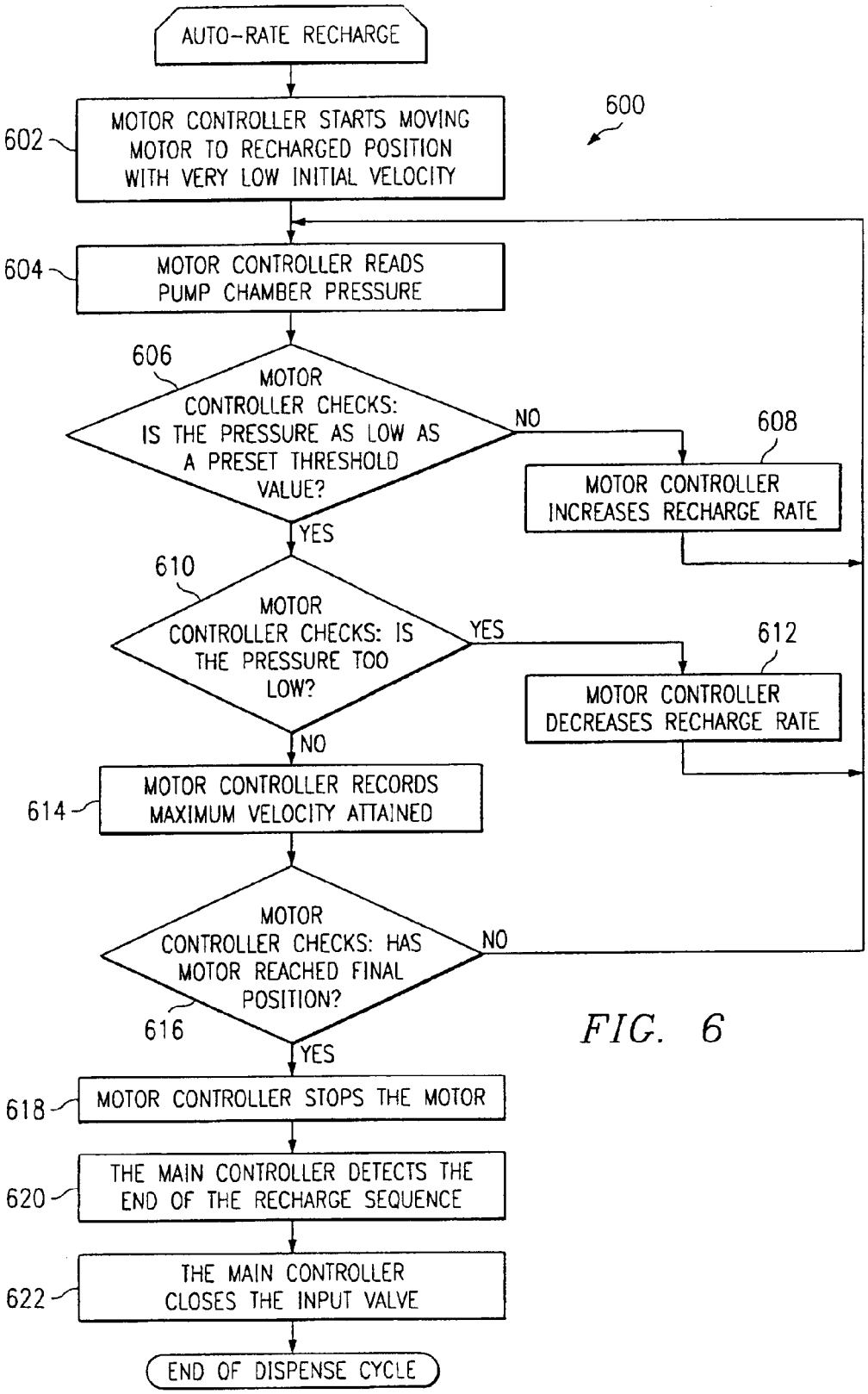
FIG. 6 is a flow diagram representing a preferred embodiment auto-rate recharge process for the fluid dispense system of FIG. 1.

FIG. 6 is a flow diagram 600 representing a preferred embodiment auto-rate recharge process for the fluid dispense system of FIG. 1. If the current recharge is the first recharge since any recipe parameters changed and an auto-rate function has been requested for the recharge, then the auto-rate recharge process of FIG. 6 is executed. The auto-rate recharge sequence starts the motor moving, at step 602, towards a recharged or fully retract position, which is shown in FIG. 2*a*. It does so at a very low initial velocity preferably received from the main controller 108. In step 604, the pump chamber pressure is measured. The recharge rate is increased (step 608), until the pressure reaches a minimum preset threshold value as determined in step 606. The recharge rate can be increased, for example by increasing the velocity of piston 206. Once the pressure reaches the minimum preset threshold value, a determination is made in step 610 as to whether the pressure is too low based on a minimum value for an acceptable range of operation. If the pressure is too low, then the recharge rate is decreased at step 612 preferably by decreasing the velocity of the piston to avoid collapsing the membrane. In step 614, the maximum velocity attained is recorded. The recorded maximum velocity may be used with subsequent dispenses.

In step 616 a determination is made as to whether the motor has reached the final position. If the motor has not reached the final position then the process starting at step 604 is repeated. If the motor has reached its final position, the motor is stopped by the motor controller in step 618. In step 620, the main controller detects the end of the recharge sequence and in step 622, the main controller closes the input valve 111.

FIG. 7 is a flow diagram 700 representing a preferred embodiment pump chamber precharge process for the fluid dispense system of FIG. 1. In step 702, all valves are closed, preferably by the main controller, so that the pump is sealed. In step 704, the motor controller determines the pump chamber pressure by reading the pump chamber pressure sensor 111 (FIG. 1). In step 706, a determination is made as to whether the pump chamber pressure is greater than a preset precharge pressure. In the preferred embodiment, the preset precharge pressure is 5 psig. If the pressure is greater than the preset precharge pressure, then in step 708 the pump piston is moved back until the pump chamber pressure is below the desired precharge pressure by a predetermined amount. In the preferred embodiment, the predetermined amount is 3 psig and the desired precharge pressure is 5 psig. In step 712, the pump is moved forward until the pump chamber pressure is at the desired precharge pressure.

In the preferred embodiment, the process of FIG. 7 is executed at the end of any operation that moves the pump piston. Because of the nature of the membrane used in the fluid dispense system of FIG. 1, it is difficult to control the pressure of the pump chamber before a dispense. This is because of the tendency of the membrane to roll, flex, crinkle and/or become permanently stretched during its service life. The preferred embodiment pump chamber precharge process of FIG. 7 compensates for one or more of these characteristics of the membrane.

It is desirable that before each dispense, the membrane is rolled properly and ready for the next dispense. The advantage of the pump chamber precharge process of FIG. 7, is that each dispense starts from the desired precharge pressure. As a result, consistency and repeatability of the process can be maintained over the service life of the membrane.

Figure 8:
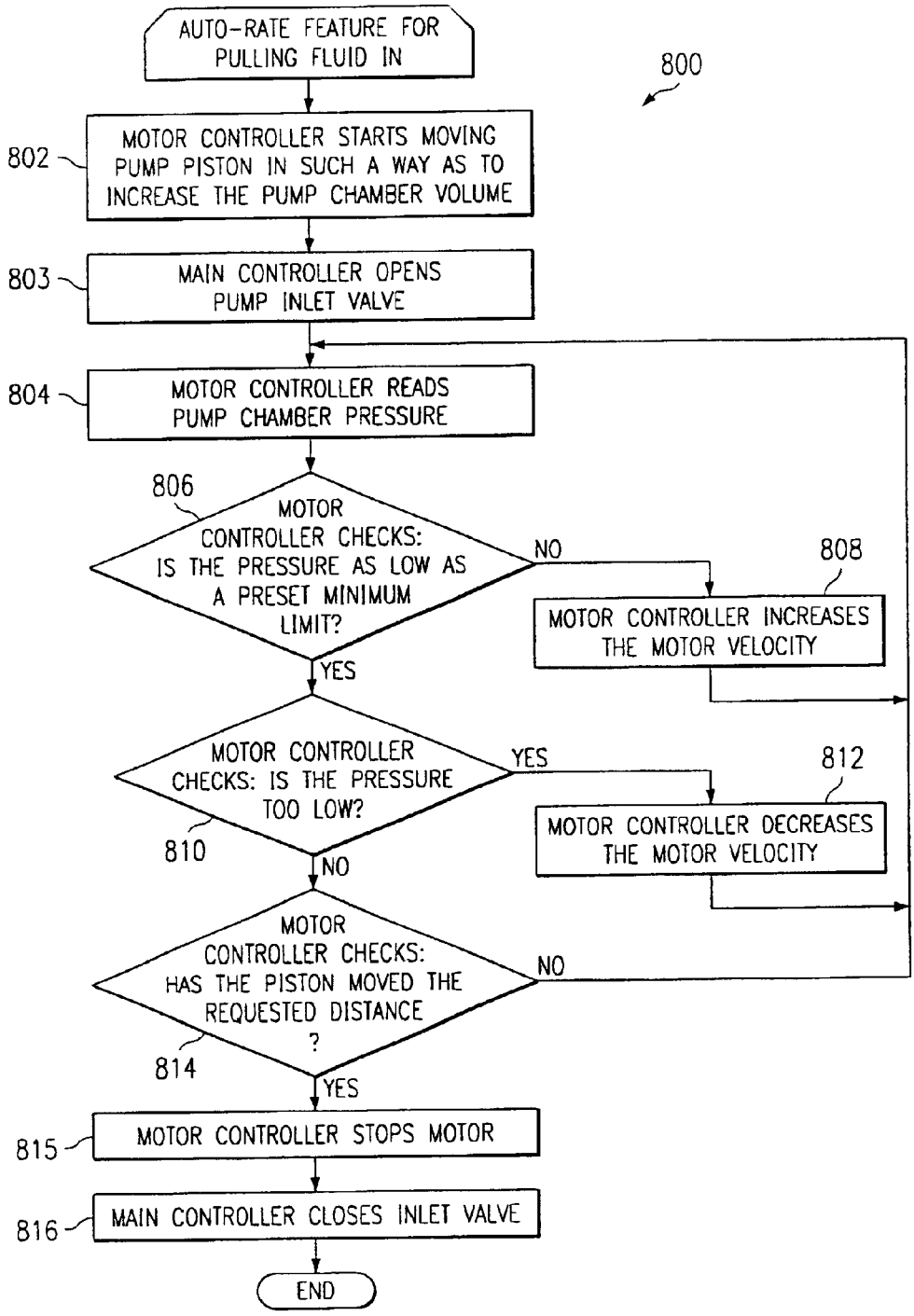
FIG. 8 is a flow diagram representing a preferred embodiment auto-rate feature for pulling fluid into a chamber of the dispensing system of FIG. 1.

FIG. 8 is a flow diagram 800 representing a preferred embodiment auto-rate feature for pulling fluid into the chamber in the dispensing system of FIG. 1. In step 802, the motor controller causes the motor to move the piston so as to increase the pump chamber volume. The increase in the pump chamber volume results in a decrease in the pump chamber pressure causing the fluid to be pulled in. In the preferred embodiment, in step 803, the input valve of the pump is opened preferably by the main controller. In step 804, the motor controller determines the pump chamber pressure by reading the pump chamber pressure sensor 111 (FIG. 1). The motor velocity is increased (step 808), until the pressure reaches a preset minimum limit as determined in step 806. In the preferred embodiment, the preset minimum limit is 8 psig. Once the pressure reaches the preset minimum limit, a determination is made in step 810 as to whether the pressure is lower than a minimum value for an acceptable range of operation. In the preferred embodiment, the minimum value for an acceptable range of operation is 10 psig. If the pressure is lower than the minimum value for an acceptable range of operation, then the motor velocity is decreased. In step 814 a determination is made as to whether the piston has moved the requested distance. If the piston has not moved the requested distance then the process starting at step 804 is repeated. If the piston has moved the requested distance, then in step 815 the motor controller stops the motor. In step 816, the main controller closes the input valve.

Figure 9:
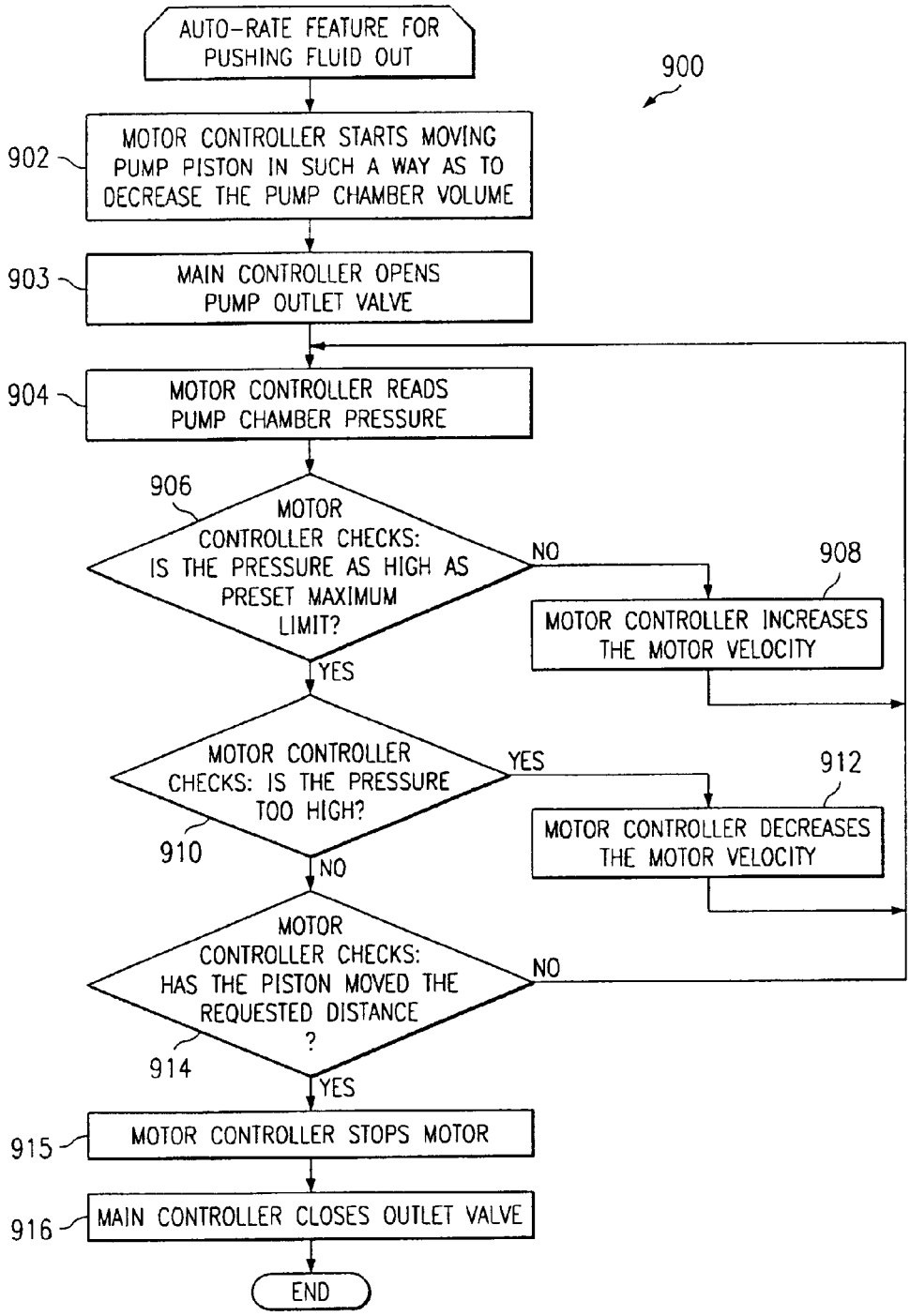
FIG. 9 is a flow diagram representing a preferred embodiment auto-rate feature for pushing fluid out of a chamber of the dispensing system of FIG. 1.

FIG. 9 is a flow diagram 900 representing a preferred embodiment auto-rate feature for pushing fluid out of the chamber in the dispensing system of FIG. 1. In step 902, the motor controller causes the motor to move the piston so as to decrease the pump chamber volume. The decrease in the pump chamber volume results in an increase in the pump chamber pressure causing the fluid to be pushed out. In the preferred embodiment, in step 903, the output valve of the pump is opened preferably by the main controller. In step 904, the motor controller determines the pump chamber pressure by reading the pump chamber pressure sensor 111 (FIG. 1). The motor velocity is increased (step 908), until the pressure reaches a preset maximum limit as determined in step 906. In the preferred embodiment, the preset maximum limit is 85 psig. Once the pressure reaches the preset maximum limit, a determination is made in step 910 as to whether the pressure is higher than a maximum value for an acceptable range of operation. In the preferred embodiment, the maximum value for an acceptable range of operation is 100 psig. If the pressure is higher than the maximum value for an acceptable range of operation, then the motor velocity is decreased. In step 914 a determination is made as to whether the piston has moved the requested distance. If the piston has not moved the requested distance then the process starting at step 904 is repeated. If the piston has moved the requested distance, then in step 915 the motor controller stops the motor. In step 916, the main controller closes the output valve.

The flow diagram of FIG. 8 is preferably used when the pump piston is moving backwards and drawing fluid into the chamber. The flow diagram of FIG. 9 is preferably used when the pump piston is moving forwards and pushing fluid out of the chamber. The pressure in the chamber depends on various factors, for example, the velocity of the piston, fluid viscosity, plumbing attachment to the pump, and/or the like. One advantage of the auto-rate processes of FIGS. 8 and 9 is that the velocity of the piston can be automatically adjusted so that the pump chamber pressure is close to the maximum or minimum allowable depending on whether the fluid is being pushed out of the chamber or being pulled into the chamber. Because the pressure in the pump chamber is adjusted automatically, another advantage of the processes of FIGS. 8 and 9 is that during priming of the pump, the pump operator does not have to monitor the pressure based on the viscosity of the fluid or how the pump is plumbed. Moreover, the priming operation is much faster than conventional manual setup operations which generally require the operator to adopt a trial and error method of setting up the pump, which requires experimentation based on the viscosity of the fluid and plumbing of the pump.

The closed loop pressure feedback from the pump chamber as described herein provides several advantages. For example, dispense correction, pressure limit detection, auto-rate functionality for moving the fluid into, out or through the pump, source empty detection, mechanical fault detection and/or the like.

Although the different embodiments of the present invention have been described above in terms of a main controller and a motor controller the invention is not so limited and in alternative embodiments a single controller can be used for performing the various functions.

Moreover, although in the different embodiments of the present invention as discussed above, the pressure sensor is incorporated in the pump the invention is not so limited. In alternative embodiments, the pressure sensor may be hydraulically linked to the pump chamber, for example through an orifice shaped and sized to allow transmission of the pressure signal generated in the pump chamber. In yet other alternative embodiment, the pressure sensor may be located in close proximity to the pump to allow the sensor to sense the pressure in the pump chamber.

The forgoing description is made in reference to one exemplary embodiment of the invention. However, the embodiment may be modified or altered without departing from the scope of the invention.

What is claimed is:

1. An apparatus for dispensing chemicals used in semiconductor fabrication processes, comprising:

a reservoir for storing a supply of a chemical used in fabrication of semiconductors;

a dispense point from which the chemical is dispensed;

a pump in fluid communication with the reservoir for pumping a desired volume of the chemical out of the dispense point, the pump including, a piston reciprocating within a pumping chamber and displacing a known volume based on a distance that it is displaced, the movement of the piston causing displacement of chemical from a pumping chamber to the dispense point;

a diaphragm partially supported by the piston and extending between the piston and sides of the pumping chamber, the diaphragm having associated with it deformation during at least a portion of a pumping cycle, the deformation resulting in displacement from the pumping chamber of a lesser volume of chemical than the volume displaced by the piston; and a controller mechanism for moving the piston to dispense the chemical through the dispense point, the controller mechanism accounting for predicted deformation of the diaphragm during dispensing in order to pump the desired volume of the chemical.

2. The apparatus of claim 1, further including a pressure sensor in communication with the pumping chamber for generating an indication of pressure of the chemical within the pumping chamber, wherein the deformation of the diaphragmn is caused, at least in part, on pressure of chemical within the pumping chamber acting against the diaphragm during displacement of the piston, and wherein controller mechanism moves the piston to account for the predicted deformation of the diaphragm based in part on the indication of pressure.

3. The apparatus of claim 2, wherein the indication of pressure is taken during a first dispense of chemical, and the predicted deformation of the diaphragm during a subsequent dispense is based at least in part of the indication of pressure from the first dispense.

4. The apparatus of claim 3, wherein the indication of pressure taken during the first dispense includes a maximum pressure sensed during the first dispense.

5. The apparatus of claim 2, wherein a velocity of movement of the piston during a dispense is adjusted in response to the indication of pressure during the dispense.

6. The apparatus of claim 1, wherein the deformation of the diaphragm is based at least in part on the desired volume of the chemical to be pumped out of the dispense point.

7. The apparatus of claim 1, further including a pressure sensor adopted for generating an indication of pressure, wherein the controller mechanism monitors the indication of pressure during displacement of the piston for a sudden pressure drop indicating a failure.

8. The apparatus of claim 1, further including a linearly reciprocating mechamcal actuator releasably coupled to the piston.

9. The apparatus of claim 1, further including a linearly reciprocating mechanical actuator releasably coupled to the piston by a removable collar.

10. The apparatus of claim 1, wherein the controller mechanism includes:

a linearly reciprocating mechanical actuator releasably joined to the piston by a collar, the collar having a removable portion that, when in place, couples the piston and actuator and, when removed, permits relative movement of the piston and actuator for disconnecting the mechanical actuator from the piston.

11. A method for dispensing a precise amount of a viscous liquid utilizing a pump with a piston partially supporting a diaphragm extending between the piston and sides of a pumping chamber, said method comprising:

determining an adjustment to a distance to move the piston to account for increased volume in the pumping chamber caused by deformation of the diaphragm during dispensing, the amount of the adjustment based at least in part on a predicted deformation of the diaphragm during dispensing;

opening an output valve of said pumping system for permitting the viscous liquid to be dispensed; and moving the piston the adjusted distance in order to displace from the pumping chamber the desired volume of viscous liquid to a dispense point, whereupon the viscous liquid is dispensed.

12. The method of claim 11, further including monitoring a pressure of the liquid in the pumping chamber during dispensing.

13. The method of claim 12 wherein said monitoring of the pressure includes monitoring for a sudden decrease in said pump chamber pressure and stopping dispensing.

14. The method of claim 12, further comprising automatically adjusting a velocity of movement of said piston in response to the pressure of the liquid in the pumping chamber during dispensing.

15. The method of claim 14, wherein automatically adjusting comprises:

increasing the velocity of movement of the piston until the pressure of the liquid in the pumping chamber reaches said predetermined maximum pressure; and decreasing the velocity of movement of the piston if the pressure is higher than a predetermined high pressure suitable for operation of said pumping system.

16. The method of claim 11, wherein the predicted diaphragm deformation is based at least in part on the desired volume of the viscous liquid to be dispensed during movement of the piston.

17. The method of claim 11, wherein the predicted diaphragm deformation is based at least in part on a pressure of the liquid within the pumping chamber measured during a prior dispense.

18. The method of claim 17, wherein the pressure of the liquid within the pumping chamber is a maximum of pressure of the liquid during the prior dispense.

19. A method for dispensing a precise amount of a viscous liquid utilizing a pump with a piston partially supporting a diaphragm extending between the piston and sides of a pumping chamber, said method comprising:

determining an adjustment to a distance to move the piston to account for increased volume in the pumping chamber caused by deformation of the diaphragm during dispensing, the amount of the adjustment based at least in part on a desired volume of the viscous liquid to be dispensed during movement of the piston;

opening an output valve of said pumping system for permitting the viscous liquid to be dispensed;

moving the piston the adjusted distance in order to displace from the pumping chamber the desired volume of viscous liquid to a dispense point, thereby dispensing the viscous liquid; and monitoring pressure of the viscous liquid in the pumping chamber.

20. The method of claim 19, wherein ihe predicted diaphragm deformation is based at least in part on a pressure of the liquid within the pumping chamber measured during a prior dispense.

21. The method of claim 20, wherein the pressure of the liquid within the pumping chamber is a maximum of pressure of the liquid during the prior dispense.

22. The method of claim 19 wherein the monitoring of the pressure includes monitoring for a sudden decrease in said pump chamber pressure and stopping dispensing.

23. The method of claim 19, further comprising automatically adjusting a velocity of movement of said piston in response to the pressure of the liquid in the pumping chamber during dispensing.

24. The method of claim 23, wherein automatically adjusting comprises:

increasing the velocity of movement of the piston until the pressure of the liquid in the pumping chamber reaches said predetermined maximum pressure; and decreasing the velocity of movement of the piston if the pressure is higher than a predetermined high pressure suitable for operation of said pumping system.

* * * * *

UNITED STATES PATENT AND TRADEMARK OFFICE

CERTIFICATE OF CORRECTION

PATENT NO. : 6,742,993 B2
DATED : June 1, 2004
INVENTOR(S) : Savard et al.

It is certified that error appears in the above-identified patent and that said Letters Patent is hereby corrected as shown below:

Column 2,
Line 60, please change “on” to -- one --;

Column 4,
Line 14, please delete “a” (third occurrence);

Column 5,
Line 25, please delete “of”;
Line 39, please delete “be”;

Column 6,
Line 40, please delete “is”;

Column 7,
Line 6, please delete “the” (second occurrence);

Column 8,
Line 61, please delete “to”; and

Column 9,
Line 62, please change “as” to -- is --;

Signed and Sealed this

Twenty-eighth Day of September, 2004

JON W. DUDAS
*Director of the United States Patent and Trademark Office*